US007381510B2

(12) United States Patent
Akiyama et al.

(10) Patent No.: US 7,381,510 B2
(45) Date of Patent: Jun. 3, 2008

(54) ELECTROPHOTOGRAPHIC PHOTOSENSITIVE MEMBER AND PRODUCING METHOD THEREFORE

(75) Inventors: Kazuyoshi Akiyama, Mishima (JP); Takahisa Taniguchi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 449 days.

(21) Appl. No.: 11/142,857

(22) Filed: Jun. 2, 2005

(65) Prior Publication Data

US 2005/0208399 A1 Sep. 22, 2005

Related U.S. Application Data

(63) Continuation of application No. PCT/JP2005/005305, filed on Mar. 16, 2005.

(30) Foreign Application Priority Data

Mar. 20, 2004 (JP) ..... 2004-074413
Mar. 16, 2005 (JP) ..... 2005-074570

(51) Int. Cl.
*G03G 15/02* (2006.01)

(52) U.S. Cl. ..... 430/57.4; 430/66; 430/128; 430/133

(58) Field of Classification Search ..... 430/57.4, 430/66, 128, 133
See application file for complete search history.

(56) References Cited

U.S. PATENT DOCUMENTS 4,798,776 A 1/1989 Honda et al. ..... 430/39
4,853,309 A * 8/1989 Hayakawa et al. ..... 430/65
5,656,406 A 8/1997 Ikuno et al. ..... 430/67
6,322,943 B1 11/2001 Aoki et al. ..... 430/66

FOREIGN PATENT DOCUMENTS

| | | |
|---|---|---|
| JP | 62-87967 | 4/1987 |
| JP | 62-89063 | 4/1987 |
| JP | 1-200268 | 8/1989 |
| JP | 2-6961 | 1/1990 |
| JP | 7-244394 | 9/1995 |
| JP | 11-2912 | 1/1999 |
| JP | 2003-29437 | 1/2003 |
| JP | 2003-285466 | 10/2003 |

OTHER PUBLICATIONS

Translation of Arguments filed in PCT JP2003-29437.

* cited by examiner

*Primary Examiner*—Mark A Chapman
(74) *Attorney, Agent, or Firm*—Fitzpatrick, Cella, Harper & Scinto

(57) ABSTRACT

An electrophotographic photosensitive member is disclosed having a first area layer and a second area layer on a substrate. The first area layer and the second area layer are formed by deposition using different methods, and an intermediate layer is provided therebetween. The intermediate layer is changed continuously in composition in such a manner that the composition at the surface in contact with the first area layer is approximately the same as the composition of the first area layer and that the composition at the surface in contact with the second area layer is approximately the same as the composition of the second area layer, whereby the various characteristics of the electrophotographic photosensitive member is prevented from deteriorating.

2 Claims, 13 Drawing Sheets

ELECTROPHOTOGRAPHIC PHOTOSENSITIVE MEMBER AND PRODUCING METHOD THEREFORE

This application is a continuation of International Application No. PCT/JP2005/005305, filed Mar. 16, 2005, which claims the benefit of Japanese Patent Application Nos. 2004-074413, filed Mar. 16, 2004, and 2005-074570, filed Mar. 16, 2005.

BACKGROUND OF THE INVENTION

1. Field of the Invention

The present invention relates to an electrophotographic photosensitive member and a producing method therefor.

2. Related Background Art

As one of members employed in an electrophotographic photosensitive member, a non-single crystalline deposition film containing silicon atoms as a principal component, for example a deposition film of an amorphous silicon (hereinafter represented as a-Si) compensated with hydrogen and/or halogen, is proposed as a photosensitive member having high performance, high durability and pollution-free properties, and some of such members are already in practical use.

Such a-Si electrophotographic photosensitive members are proposed having various layered structures for meeting requirements for various properties, and in particular a surface layer is recognized as an important layer for realizing various properties of the electrophotographic photosensitive members, such as abrasion resistance, charge holding properties, environmental resistance, light-transmitting properties and the like.

As a shorter wavelength is contemplated for image exposure for achieving a higher definition in a copying apparatus, the surface layer is particularly required to have characteristics of a wide band gap which can transmit short-wavelength light with less absorption.

As materials capable of satisfying such characteristics, for example, a metal fluoride and a silicon nitride may be cited.

As an electrophotographic photosensitive member utilizing such a material, a structure is disclosed utilizing magnesium fluoride in the surface layer (for example cf. Japanese Patent Application Laid-open No. 2003-29437).

Japanese Patent Application Laid-open No. 2003-29437 discloses that magnesium fluoride employed as the surface layer provides excellent properties such as inhibition of image blur or image deletion, and potential variation due to abrasion.

Thus, not only magnesium fluoride but also metal fluorides in general are expected to provide properties preferred as the material of the surface layer of the electrophotographic photosensitive member owing to hardness, light-transmitting properties and low surface energy.

On the other hand, from the standpoint of a process for forming a deposition film, a plasma CVD process is preferable for forming a photoconductive layer or the like because a relatively large film thickness is required and also because a raw material gas is easily available, but a raw material for the surface layer, usable in the plasma CVD process, is not necessarily easily available. For example, in a metal material usable as a raw material for a metal fluoride, raw material atoms are difficult to supply from a gaseous substance, so that a PVD process, typified by sputtering, is suitable for forming the surface layer.

Therefore, the afore-mentioned patent literature discloses an example of forming an electrophotographic photosensitive member constituted of a lower blocking layer, a photoconductive layer, a buffer layer and a surface layer, by utilizing a plasma CVD process for the lower blocking layer, the photoconductive layer and the buffer layer and a sputtering for the surface layer.

It is thus rendered possible, by employing an optimum forming process for each layer, to obtain a practical electrophotographic photosensitive member capable of improving electrical and optical characteristics, resistance to environmental conditions and durability, and further to achieve a higher definition of images.

SUMMARY OF THE INVENTION

However, electrophotographic photosensitive members still leave room for improvement.

In the case of employing different film depositing processes, for example, for the photoconductive layer and the surface layer, an interface is inevitably generated therebetween, and, depending on the state of such an interface, phenomena of image quality deterioration often occur such as an image memory phenomenon, e.g a ghost, and image deletion in which an image is blurred in its contour. Also electrical characteristics such as a residual potential and a photosensitivity may be affected.

The electrophotographic apparatus is progressing toward higher image quality, and a gradation representation has become an important factor not only in a full-color field but also in a monochromatic field. For achieving gradation representation while maintaining a high resolution, image formation with higher definition is needed, and a spot diameter of a light beam for exposing an image on an electrophotographic photosensitive member is becoming inevitably smaller.

Among the afore-mentioned drawbacks, the image deletion in particular is now recognized as a cause of deterioration in gradation. In a digital electrophotographic apparatus, dots are formed by exposure with a light beam, and the gradation is represented by density and size, and optical density in some cases, of dots. In this case it is necessary to form, on the electrophotographic photosensitive member, a latent image faithful to a light beam spot corresponding to a dot, but if image deletion occurs, the latent image becomes shallower and wider in potential to lower the reproducibility of the dot in the image formation, thereby resulting in such phenomena that the dots mutually interfere on the copied image to provide unnecessarily high density or that the dots themselves are no longer formed, whereby the gradational representation is disrupted.

Such phenomena have not been evident in the conventional electrophotographic process utilizing a light beam of a relatively large spot size, but with the recent progress toward higher definition, even a very small image deletion phenomenon now appears conspicuously as a defect.

On the other hand, already known measures may not be able to provide sufficient effects on such drawbacks.

For example, the image deletion is already known to be caused by the fact that a highly hydrophilic layer is formed on the surface of the electrophotographic photosensitive member and adsorbs moisture, thereby reducing the electrical resistance. As a countermeasure against such drawback, Japanese Patent Application Laid-open No. 2003-29437 discloses a method of installing a heater inside the electrophotographic photosensitive member.

However, particularly fine image deletion, which is a technical subject to be solved by the present invention, is not necessarily resolved by such a measure, and is considered to result from a cause different from the cause that has been known.

In order to solve the afore-mentioned technical subjects, the present invention provides an electrophotographic photosensitive member which forms high quality images and has superior electrical characteristics while including deposition films formed by different processes, and at the same time, improves its performance by optimizing deposition film forming conditions for each layer and exploiting the characteristics of each deposition film forming process. More specifically, the present invention provides a method for forming an electrophotographic photosensitive member, which comprises forming in succession on a conductive substrate a first area layer including a photoconductive layer composed essentially of amorphous silicon and a second area layer including a surface layer, wherein the first area layer and the second area layer are formed respectively by different deposition film forming processes, and an intermediate layer is provided between the first area layer and the second area layer and is continuously changed in its composition in such a manner that a composition of the intermediate layer at its surface on the first area layer side is approximately the same as a composition of the first area layer at its surface on the intermediate layer side and that a composition of the intermediate layer at its surface on the second area layer side is approximately the same as a composition of the second area layer at its surface on the intermediate layer side.

The present invention also provides an electrophotographic photosensitive member comprising in succession on a conductive substrate a first area layer including a photoconductive layer composed essentially of amorphous silicon and a second area layer including a surface layer, wherein the surface layer is formed from a material composed essentially of a metal fluoride or a silicon nitride, an intermediate layer is provided between the first area layer and the second area layer and is continuously changed in its composition in such a manner that a composition of the intermediate layer at its surface on the first area layer side is approximately the same as a composition of the first area layer at its surface on the intermediate layer side and that a composition of the intermediate layer at its surface on the second area layer side is approximately the same as a composition of the second area layer at its surface on the intermediate layer side.

As will be explained below, according to the present invention, an electrophotographic photosensitive member can be provided in which a structural interface is effectively prevented from being formed even in the case of selecting different processes optimum for respective materials of the photoconductive layer and the surface layer, thereby exhibiting excellent image characteristics and potential characteristics and realizing stable characteristics over a prolonged period. Also image characteristics with excellent gradation can be obtained even when image exposure is carried out using a light beam of a spot diameter of 40 μm or less.

In addition, an electrophotographic photosensitive member excellent in image characteristics and potential stability can be obtained using metal fluoride or silicon nitride for the surface layer.

DETAILED DESCRIPTION OF THE PREFERRED EMBODIMENTS

Figure 1:
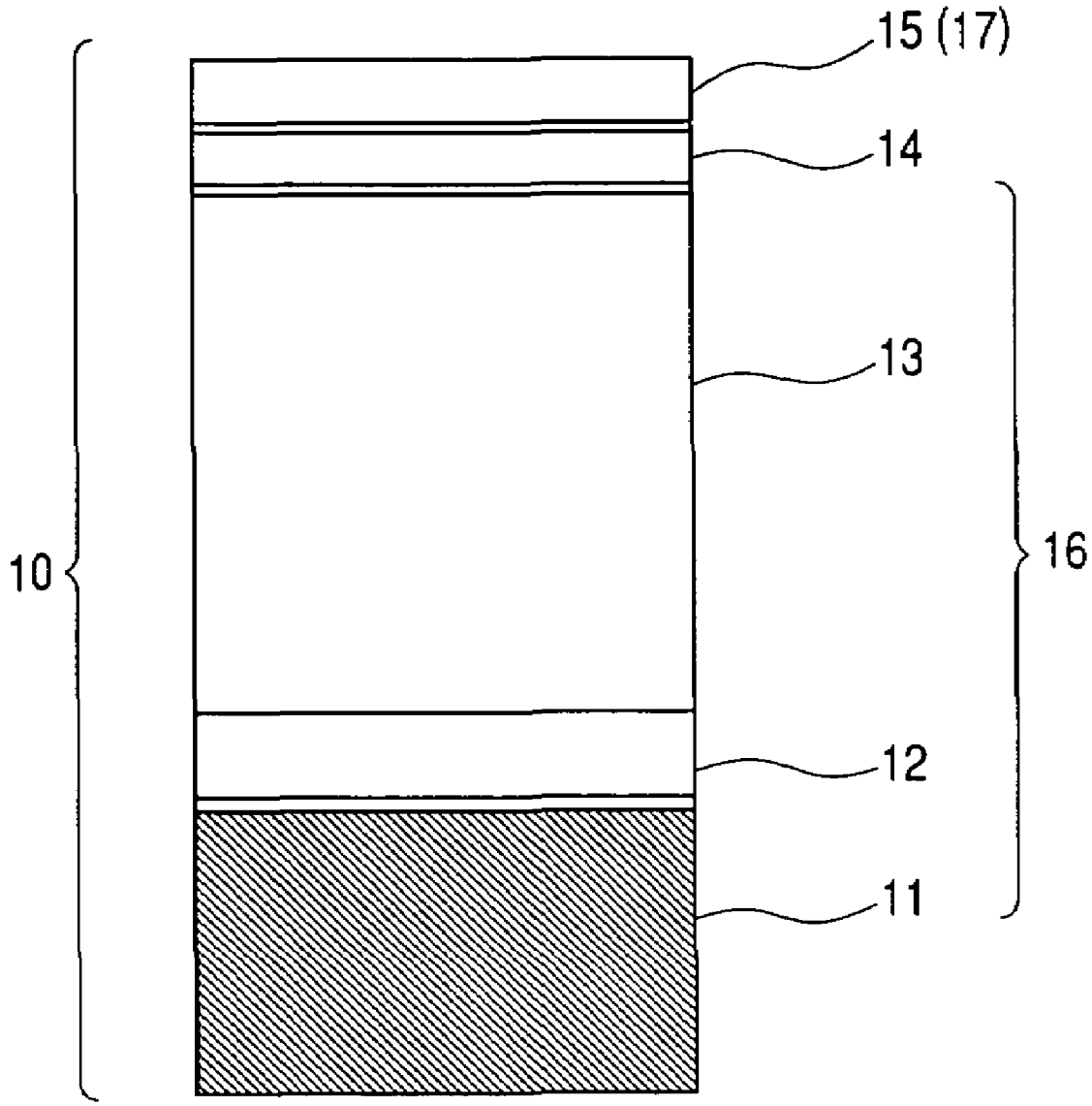
FIG. 1 is a view showing a layer structure of an electrophotographic photosensitive member.

The present invention provides an intermediate layer between deposition layers formed by different deposition film forming processes, and causes the intermediate layer to change continuously in its composition.

Various processes employable for forming a deposition film representatively include, in addition to the plasma CVD and the sputtering mentioned above, vacuum evaporation, ion plating, thermal CVD, optical CVD and the like.

According to the finding of the present inventors, various drawbacks in an electrophotographic photosensitive member occurring when different deposition film forming processes are employed for the photoconductive layer and the surface layer are supposed to arise from the structural difference between the deposition films caused by the difference between the forming methods.

Details of such phenomenon are supposed as follows.

In general, when a deposition film is formed on a surface out of a substance, the deposited material does not grow uniformly on the surface but grows in an island form on a certain nucleus. Such a nucleus is referred to as a growth nucleus. Because of such a situation, when different deposition films are superposed, a structural interface ascribable to the difference between the glowing states of the films is generated separately from an interface caused by the difference between the compositions.

Such a structural interface, though variable depending on the compositions of the superposed deposition films and forming conditions thereof, becomes more evident in the case of forming deposition films by mutually different forming processes.

It is known that the structure in the deposition film becomes different according to the deposition film forming process due to a difference in a process of generating atoms or radicals as a source of the deposition film, or due to a difference in a bonding process in the course of forming the deposition film. In the case of superposing such deposition films, growth nuclei of atoms constituting an upper layer (for example a surface layer) are formed on the surface of a lower layer (for example a photoconductive layer), and it is thought that transient areas are formed until a uniform layer is formed from the growth nuclei due to the difference between the growing processes of the deposition films. Thus, it is supposed that a small gap is formed between the lower layer and the upper layer and that such gap constitutes the structural interface.

The above-explained tendency, supposed in connection with the formation of the structural interface, becomes particularly evident when a lower layer is formed by a plasma CVD process and an upper layer is formed by a sputtering process.

In the plasma CVD process, the deposition film, often subjected to an ion bombardment from plasma in the course of film formation to accelerate a three-dimensional coupling, does not usually show an evident structure in the film. In the sputtering method, the deposition film often grows a pillar-shaped structure because such ion bombardment is not so common. As the plasma CVD process and the sputtering process have such significant difference in the deposition film growing process, the transient areas tend to become larger before a uniform deposition film of the upper layer is formed on the lower layer, whereby a larger gap is easily formed.

In the following, the structural interface is assumed to include such gap.

The electrophotographic photosensitive member is required to have such an ability that charges retained on a surface can smoothly move in the deposition layers when subjected to image exposure. However, in the presence of a structural interface, charges tend to be trapped therein and movement of charges is hindered. The trapped charges have a property of moving along the interface and tend to cause a flow in the direction of the surface instead of movement in the thickness direction of the photosensitive member, thereby causing an image deletion phenomenon in which the image contour becomes unclear.

The charges trapped in the structural interface are not easily dissipated, and may cause a ghost phenomenon due to a potential change in a next image formation or may affect potential characteristics, thereby inducing residual potential or fluctuation in photosensitivity.

When repeated image formation is carried out over a long period of time using an electrophotographic apparatus, the structural interface is subjected not only to a mechanical stress but also to an electrical stress. The structural interface, basically not constituted of uniform deposition films but involving a fragile bonding state, causes a change in the bonding state around the structural interface, thus resulting in changes in the image characteristics and the potential characteristics as explained above.

Among the drawbacks in the characteristics of the electrophotographic photosensitive member resulting from such structural interface, an image deletion phenomenon in particular is minor in comparison with the aforementioned case caused by adhesion of low resistance substance on the surface, and may not be recognized as image deletion in a binary image including no halftone. However, small image deletion often brings about an evident deterioration in dot reproducibility, namely in gradation characteristics.

Particularly where a spot diameter of a light beam for image exposure is made smaller, a latent image formed on the electrophotographic photosensitive member becomes sharper, whereby the influence of the small image deletion appears more strongly. As a result, neighboring dots mutually interfere to result in phenomena such that an image with excessively high density is formed or a dot is not formed as an image. Therefore the gradational property is apt to more easily affected as the light beam spot diameter is smaller.

Such deterioration in the dot reproducibility, brought about inside the layers of the electrophotographic photosensitive member, are often not remedied by heating the electrophotographic photosensitive member with a heater, which has been employed conventionally as a countermeasure against the image deletion.

As a result of detailed investigations on an interface formation based on these findings, the present inventors have found that the generation of a structural interface can be reduced even in the case of superposing layers formed by different forming processes, if such layers have an approximately the same composition.

It is supposed that in the case of forming deposition films having approximately the same composition, an atomic distance and a bonding energy of atoms constituting the lower layer become similar to those of atoms constituting the upper layer, thereby forming the aforementioned growth nuclei in a high density. For this reason, even in the case of forming the lower layer by a plasma CVD process and the upper layer by a sputtering process, a uniform deposition film is supposed to be formed earlier than in the case where their compositions are different, thereby effectively preventing a small gap from being generated.

When forming an intermediate layer between the deposition films formed by different forming processes and changing the composition of the intermediate layer in a continuous manner, an electrophotographic photosensitive member can be obtained in which the generation of the structural interface is effectively prevented so as not to cause the occurrence of a ghost or image deletion, a deterioration in the gradation characteristics, and a deterioration in electrical characteristics such as a residual potential and a photosensitivity, thereby showing a less change in characteristics even after repeated image formations over a prolonged period.

In the present invention, in a process for forming an electrophotographic photosensitive member, a first area layer including a photoconductive layer and a second area layer including a surface layer are formed by mutually different deposition film forming processes. This is because the photoconductive layer and the surface layer often necessitate entirely different materials as they require considerably different properties and conditions such as a film thickness and it is most effective to form these layers by different forming processes while optimizing each of the forming processes.

In the case where a layer other than the photoconductive layer and the surface layer is provided in the layer structure of the electrophotographic photosensitive member, a method suitable for each layer may be selected from among the deposition film forming processes employed in forming the photoconductive layer and the surface layer.

For example, in the case of forming an electrophotographic photosensitive member including a photoconductive layer and a surface layer, an intermediate layer is formed between the photoconductive layer (i.e., the first area layer) and the surface layer (i.e., the second area layer), where the composition of the intermediate layer may be continuously changed so that the composition of the intermediate layer at its surface on the photoconductive layer side is approximately the same as the composition of the photoconductive layer and the composition of the intermediate layer at its surface on the surface layer side is approximately the same as the composition of the surface layer.

Also in the case of forming an electrophotographic photosensitive member having, on a conductive substrate, a lower charge injection blocking layer, a photoconductive layer, an upper charge injection blocking layer and a surface layer, the conductive substrate, the lower charge injection blocking layer, and the photoconductive layer as the first area layer can be formed for example by a plasma CVD process, and the surface layer as the second area layer can be formed for example by a sputtering process.

In such a case, the intermediate layer is formed between the upper charge injection blocking layer and the surface layer, and the surface of the intermediate layer on the first area layer side refers to the surface of the intermediate layer in contact with the upper charge injection blocking layer. Also the surface of the intermediate layer on the second area layer side refers to the surface of the intermediate layer in contact with the intermediate layer, and the surface of the second area layer on the intermediate layer side refers to the surface of the surface layer in contact with the intermediate layer.

Thus, the composition of the intermediate layer may be so changed in a continuous manner that the composition of the intermediate layer at the surface thereof in contact with the upper charge injection blocking layer is approximately the same as that of the upper charge injection blocking layer on the intermediate layer side and that the composition of the intermediate layer at the surface thereof in contact with the surface layer is approximately the same as that of the surface layer on the intermediate layer side.

In the invention, in the case of the aforementioned layer structure, it is also possible to form the lower charge injection blocking layer and the photoconductive layer as the first area layer for example by a plasma CVD process, and to form the upper charge injection blocking layer and the surface as the second area layer for example by a sputtering process.

In such a case, the intermediate layer is formed between the photoconductive layer and the upper charge injection blocking layer, and the surface of the intermediate layer on the first area layer side refers to the surface of the intermediate layer in contact with the photoconductive layer. Also the surface of the intermediate layer on the second area layer side refers to the surface of the intermediate layer in contact with the upper charge injection blocking layer, and the surface of the second area layer on the intermediate layer side refers to the surface of the upper charge injection blocking layer in contact with the intermediate layer.

Thus, the composition of the intermediate layer may be so changed in a continuous manner that the composition of the intermediate layer at the surface thereof in contact with the photoconductive layer is approximately the same as that of the photoconductive layer on the intermediate layer side and that the composition of the intermediate layer at the surface thereof in contact with the upper charge injection blocking layer is approximately the same as that of the upper charge injection blocking layer on the intermediate layer side.

As shown in these examples, the first area layer and the second area layer may be optionally selected so as to include a layer structure desired in designing an electrophotographic photosensitive member, and the intermediate layer is so constructed, on the surfaces thereof in contact respectively with the first area layer and the second area layer, as to have compositions approximately the same as those of the respective layers.

In the invention, as described above, it is essential to form an intermediate layer between layers formed respectively by different deposition film forming processes and to continuously change the composition of the intermediate layer, but it is also possible to add a changing layer having a continuously changing composition in another position. For example in the case of forming a lower charge injection blocking layer and a photoconductive layer as the first area layer for example by a plasma CVD process and forming an upper charge injection blocking layer and a surface layer as the second area layer for example by a sputtering process, a changing layer may be added between the lower charge injection blocking layer and the photoconductive layer or between the upper charge injection blocking layer and the surface layer.

Also a continuous composition change may be realized individually in each layer. In the case where a layer in contact with the intermediate layer shows a continuous composition change, compositions are so selected as to become approximately the same at the surfaces coming in contact with each other. For example, in a layer structure in which a lower charge injection blocking layer and a photoconductive layer are formed as the first area layer and a surface layer is formed as the second area layer where the composition of the photoconductive layer is changed in a continuous manner, the composition of the photoconductive layer on the intermediate layer side and that of the intermediate layer on the photoconductive layer side may be so selected as to be approximately the same.

In the invention, "approximately the same composition" referred to herein includes a change within a range of ±30% in a content ratio of principal elements constituting each layer.

For example, in a layer configuration including the upper charge injection blocking layer which is formed by a-Si constituted of silicon (Si), since a principal element constituting the upper charge injection blocking layer is Si and the content ratio thereof is 100 atomic %, the effects of the invention can be attained when the surface of the intermediate layer on the upper charge injection blocking layer side has a Si content ratio within a range of 70 to 100 atomic %.

In addition, with a layer configuration including the upper charge injection blocking layer which is formed by a-SiC constituted of silicon (Si) and carbon (C) and the Si:C content ratio is 6:4, the Si content ratio according to the approximately the same composition in the present invention has a lower limit of 30 atomic %, so that Si may not be an element of a highest content ratio. In this case, Si and C are considered as principal elements constituting the upper charge injection blocking layer, and the composition of the intermediate layer at its surface on the upper charge injection blocking layer side is so selected that a difference in the content ratio of each element is within a range of ±30%.

The reason therefore is considered to be that the bonding states of the atoms constituting each layer largely depend on the bonding states of atoms primarily contained in the layer, so that the growth nuclei can be formed in high density when the content ratios of principal atoms constituting the layers are in consistency with each other.

When forming an amorphous deposition film, hydrogen (H) or halogen such as fluorine (F) is commonly included to compensate dangling bonds, but such elements have almost no influence on the bonding state, and so, may be excluded from the composition in the invention.

In the invention, a composition change in the intermediate layer may be executed in any method as long as a continuous composition change can be obtained. For example, it may be an entirely changing layer in which the composition is changed at a constant rate from one surface to the other surface, or a structure including a constant area with a constant composition in the vicinity of at least one surface, and a changing area in which the composition is changed continuously. In such a structure, the constant area is given an approximately the same composition as in a layer in contact therewith, and the constant area and the changing area are given approximately the same composition at the portion where they are in contact with each other.

In the invention, the intermediate layer is formed by a deposition film forming process the same as that for a layer positioned above the intermediate layer, namely the second area layer. For example, when the second area layer is formed by a sputtering process, the intermediate layer is also formed by a sputtering process.

For changing the composition of the intermediate layer in a sputtering process, there can be employed for example, a method may be employed, in a deposition film depositing apparatus having plural targets, in which an electric power applied to each target is continuously changed to vary a deposition rate of atoms derived from each target.

Also, the intermediate layer may be formed not only by a single deposition film forming process, but also by plural deposition film forming processes in combination at the same time, for the purpose of changing the composition.

For example, in case of utilizing a plasma CVD process for forming the first area layer and a sputtering process for forming the second area layer, the plasma CVD process and the sputtering process may be used in combination for forming the intermediate layer.

In this case, at a stage where the formation of a lower layer by the plasma CVD process is finished, an electric power is gradually applied to a target to increase the deposition rate of the atoms derived from the target and a raw material gas for the plasma CVD process is gradually decreased, thereby causing a continuous change of the composition from the lower layer to the surface layer. This method can achieve the most effective relaxation in the structural change in the deposition films formed by the plasma CVD process and the sputtering process.

In the case of employing plural deposition film forming processes for forming the intermediate layer, at least one of them is required to be the same as the forming process for the second area layer, and in the intermediate layer on the second area layer side, atoms constituting a composition approximately the same as the second area layer are required to be deposited by a process the same as that for the second area layer.

In the invention, a continuous change in the composition of the intermediate layer is not limited to the aforementioned process, but may be achieved by any process as long as the same process is included in the formation of the intermediate layer and the second area layer.

The electrophotographic photosensitive member of the invention will be described below in detail.

(Structure of Electrophotographic Photosensitive Member)

An electrophotographic photosensitive member of the present invention is formed by superposing on a conductive substrate a photoconductive layer principally formed out of amorphous silicon, and a surface layer having an amorphous bonding state in at least one part.

FIG. 1 is a schematic cross-sectional view showing an electrophotographic photosensitive member 10 employed in the invention.

An a-Si photosensitive member shown in FIG. 1 includes an conductive substrate 11 such as of aluminum, and a lower charge injection blocking layer 12, a photoconductive layer 13, an intermediate layer 14 and a surface layer 15 superposed in succession on the surface of the conductive substrate 11, wherein the lower charge injection blocking layer 12 and the photoconductive layer 13 constitute a first area layer 16, and the surface layer 15 constitutes a second area layer 17.

The lower charge injection blocking layer 12 is provided for blocking a charge injection from the conductive substrate 11 to the photoconductive layer 13, as needed, and may be omitted. Also the photoconductive layer 13 is constituted of an amorphous material containing at least silicon atoms and shows a photoconductive property.

In the following, detailed description on an example of the configuration of the electrophotographic photosensitive member of the invention will be given.

(Conductive Substrate)

A conductive substrate is not limited to specific substance, and may be formed out of any material, for example a metal such as Al, Cr, Mo, Au, In, Nb, Te, V, Ti, Pt, Pd or Fe, or an alloy thereof such as stainless steel. A conductive substrate may be constituted of an electrically insulating substrate for example a plastic film or sheet such as of polyester, polyethylene, polycarbonate, cellulose acetate, polypropylene, polyvinyl chloride, polystyrene or polyamide, or glass or ceramics of which at least one surface for bearing the photoconductive layer is subjected to conductive treatment.

(Photoconductive Layer)

A photoconductive layer 13 can be formed by a known thin film deposition process such as plasma CVD, sputtering, vacuum evaporation, ion plating, optical CVD or thermal CVD. Such deposition film forming processes are suitably selected according to producing conditions, a magnitude of a capital investment for facilities, a manufacturing scale, and characteristics required for the electrophotographic photosensitive member to be produced, but a plasma CVD process is the most preferred as it allows relatively easy control of the conditions for producing an electrophotographic photosensitive member of desired characteristics.

The plasma CVD process is referred to as a DC plasma CVD, or an AC plasma CVD depending on a type of electric power for generating glow discharge, or as a high frequency plasma CVD, an RF plasma CVD, a VHF plasma CVD, and a microwave plasma CVD, according to a type of high frequency, but the plasma CVD referred to in the invention basically refers to a process of decomposing a raw material by glow discharge to obtain a deposition layer, and includes all these processes.

The photoconductive layer 13 is formed by the plasma CVD process, as already known, basically through introducing a Si supplying raw material gas capable of supplying silicon atoms (Si), and an H supplying raw material gas capable of supplying hydrogen atom (H) in a desired gaseous state into a reaction chamber of which interior can be reduced in pressure, and generating a glow discharge in the reaction chamber to decompose the raw material gasses, thereby forming a layer of a-Si (also written as a-Si:H) on the conductive substrate 11 placed in advance in a predetermined position.

Also hydrogen atoms are required to be contained in the photoconductive layer 13 in order to compensate dangling bonds of silicon atoms and to improve a quality of the layer, particularly a photoconductivity and a charge holding property, and the content of the hydrogen atoms is preferably 10 atomic % or more, particularly 15 atomic % or more with respect to the sum of silicon atom and hydrogen atoms, and preferably 30 atomic % or less, particularly 25 atomic % or less with respect to the sum of silicon atom and hydrogen atoms.

In the invention, a raw material gas capable of supplying silicon atoms is advantageously a silane such as silane ($SiH_4$) or disilane ($Si_2H_6$).

Also a raw material gas capable of supplying hydrogen atoms is advantageously hydrogen ($H_2$) in addition to the silanes mentioned above.

In the invention, halogen atoms (X) may be employed in addition to the hydrogen atoms (H) for compensating the dangling bonds of the silicon atoms. A halogen atom source advantageously employable in the invention can be a halogen compound such as fluorine gas ($F_2$), BrF, ClF, $ClF_3$, $BrF_3$, $BrF_5$, $IF_3$ or $IF_7$. Also, the following may be advantageously employed a silicon compound containing a halogen atom, so-called silane derivatives substituted with a halogen atom, more specifically silicon fluoride such as $SiF_4$ or $Si_2F_6$.

In the invention, the photoconductive layer 13 preferably includes, if necessary, an atom for controlling a conductivity. The conductivity-controlling atom may be contained in a uniform distribution over the photoconductive layer 13 or may be present in a state of containing an uneven distribution in the direction of thickness.

The atom for controlling the conductivity can be so-called impurity in the semiconductor technology, and can be an atom belonging to the group 13 of the periodic table (hereinafter represented as the "group 13 atom") or an atom belonging to the group 15 of the periodic table (hereinafter represented as the "group 15 atom").

More specifically, the group 13 atom can be boron (B), aluminum (Al), gallium (Ga), indium (In) or thallium (Th), preferably B, Al or Ga, and the group 15 atom can be phosphor (P), arsine (As), antimony (Sb) or bismuth (Bi), preferably P or As.

The content of the atoms contained in the photoconductive layer 13 for controlling the conductivity thereof is $1\times10^{-2}$ atomic ppm or higher, preferably $5\times10^{-2}$ atomic ppm or higher and further preferably $1\times10^{-1}$ atomic ppm or higher. It is also $1\times10^{4}$ atomic ppm or less, preferably $5\times10^{3}$ atomic ppm or less and further preferably $1\times10^{3}$ atomic ppm or less.

The atoms for controlling the conductivity, such as the group 13 atoms or the group 15 atoms, can be structurally introduced, in the layer formation, by introducing a raw material for the group 13 atoms or a raw material for the group 15 atoms in a gaseous state, together with other gasses for forming the photoconductive layer 13, into the reaction chamber. The raw material for the group 13 atoms or the raw material for the group 15 atoms is preferably a material that is in a gaseous state under normal temperature and normal pressure, or a material that can be easily gasified at least under layer forming conditions.

For example, in the case of employing B as an atom for controlling the conductivity, diborane ($B_2H_6$) or a halide such as $BF_3$ or $BCl_3$ may be used.

In addition, when employing P as an atom for controlling the conductivity, phosphine ($PH_3$) or the like may be used.

If necessary, such raw material for introducing conductivity controlling atoms may be diluted with $H_2$ or He.

In the invention, it is also effective to include at least one of carbon atoms, oxygen atoms and nitrogen atoms in the photoconductive layer 13. The content (total content) of the carbon atoms, oxygen atoms and nitrogen atoms is preferably $1\times10^{-5}$ atomic % or higher with respect to the sum of the silicon atoms, carbon atoms, oxygen atoms and nitrogen atoms, more preferably $1\times10^{-4}$ atomic % or higher and further preferably $1\times10^{-4}$ atomic % or higher, and preferably 10 atomic % or less with respect to the sum of the silicon atoms, carbon atoms, oxygen atoms and nitrogen atoms, more preferably 8 atomic % or less and further preferably 5 atomic % or less. The carbon atoms, oxygen atoms and nitrogen atoms may be contained in a uniform distribution over the photoconductive layer 13 or may be present in a state of containing an uneven distribution showing a change in the content in the direction of thickness.

In the invention, a thickness of the photoconductive layer 13 is suitably determined so as to obtain desired electrophotographic characteristics and in consideration of an economical effect, but is preferably 15 μm or more, particularly 20 μm or more and is preferably 60 μm or less, particularly preferably 50 μm or less and further preferably 40 μm or less. A thickness of the photoconductive layer 13 less than 15 μm increases a current flowing into a charging member, thereby tending to accelerate a deterioration. Also a thickness of the photoconductive layer 13 exceeding 60 μm may result in an abnormally large growth portion in the a-Si photosensitive member, more specifically in a dimension of 50-150 μm in the horizontal direction and 5-20 μm in the height direction, thereby causing a not negligible damage to a member frictionally sliding on the surface or generating an image defect.

(Intermediate Layer)

An intermediate layer 14 in the invention is positioned between the first area layer and the second area layer, namely in the layer configuration shown in FIG. 1, between the photoconductive layer 13 and the surface layer 15, and has a composition changing continuously in such a manner that the surface on the photoconductive layer side has a composition approximately the same as that of the photoconductive layer 15 on the intermediate layer side, and that the surface on the surface layer side has a composition approximately the same as that of the surface layer 15 on the intermediate layer side.

Consequently, materials constituting the intermediate layer 15 are determined by the materials employed for forming the photoconductive layer 13 and the surface layer 15.

Details of the intermediate layer 14 are as described above, and will not be explained in repetition.

(Surface Layer)

A surface layer 15 in the invention may be formed out of silicon carbide (SiC), silicon nitride ($Si_3N_4$) or a metal fluoride. Among these, silicon nitride or a metal fluoride has a wide band gap, thus showing an excellent light transmission of, for example, an image exposing light of a blue light region. A metal fluoride shows a satisfactory toner releasing property because of a low surface energy and can improve the performance of the electrophotographic photosensitive member because low-resistance substance is difficult to accumulate on the surface, thus being used as the most preferred substance.

In the case where a metal fluoride is employed in the surface layer, the following may be used as a raw material, such as magnesium fluoride ($MgF_2$), lanthanum fluoride ($LaF_3$), barium fluoride ($BaF_2$), or calcium fluoride ($CaF_2$), among which magnesium fluoride, lanthanum fluoride or barium fluoride has a high hardness and optimum characteristics as the material for the surface layer.

The surface layer 15 of the invention may be formed, as in the photoconductive layer 13, by a known process such as plasma CVD, sputtering, vacuum evaporation, ion plating, optical CVD or thermal CVD, but at least the photoconductive layer 13 and the surface layer 15 are formed respectively by different film forming processes.

A method for forming the surface layer 15 is appropriately selected according to the material to be employed and so as to be different from the forming method for the photoconductive layer, and in the case of employing the aforementioned metal fluoride as the material for the surface layer, a sputtering process is the most suitable as the selection of the raw material is the easiest and as a compound can be easily formed by employing a reactive gas (fluorine in this case).

Also in the case of employing silicon nitride for the surface layer 15, a sputtering process may be advantageously employed as a uniform light transmission and a hardness can be obtained over a wide area.

The surface layer formed out of the afore-mentioned material is only required to have an amorphous, bonding state at least in one part, and is therefore not limited to a stoichiometric composition as mentioned above, but may have various composition ratios.

A sputtering process employing such reactive gas is often called a reactive sputtering, but it is simply represented as a sputtering in the invention.

In addition, the sputtering process is often classified as a DC sputtering utilizing a DC electric field, an AC sputtering utilizing an AC electric field or a magnetron sputtering utilizing a magnetic field generated in the vicinity of a target, but the sputtering referred to in the invention basically includes all the processes of hitting particles against the target, thereby resulting in a sputtering phenomenon, and any of the processes may be utilized.

In the invention, based on the foregoing reasons, a combination of forming at least the photoconductive layer by the plasma CVD process and forming the surface layer by the sputtering process is the most preferable, thereby easily obtaining an electrophotographic photosensitive member employing a metal fluoride or silicon nitride as the surface layer and realizing excellent image quality and potential characteristics.

(Lower Charge Injection Blocking Layer)

In the case where a lower charge injection blocking layer 12 is provided, there is formed a deposition layer by including a dopant such as a group 13 atom or a group 15 atom generally in a-Si(H, X) to control a conductive type, thereby realizing a blocking ability for the carriers from the conductive substrate. If necessary, at least a kind of atom selected from carbon atoms, nitrogen atoms and oxygen atoms may be included.

The lower charge injection blocking layer 12 can be formed by a known process the same as that for the photoconductive layer 13.

Though it is also possible, as for a combination, to form the lower charge injection blocking layer 12 and the photoconductive layer 13 respectively by different forming processes and to provide an intermediate layer therebetween, this combination is not considered to be practical as it unnecessarily complicates the forming method for the electrophotographic photosensitive member.

In the invention, in addition to the layer configuration described above, if necessary, an upper charge injection block layer 12*a* or the like may be added between the photoconductive layer 13 and the intermediate layer 14. The design of the layer can be suitably selected in order to obtain characteristics desired for the electrophotographic photosensitive member.

The electrophotographic photosensitive member of the invention can be satisfactorily employed in any type of electrophotographic apparatus, but is adapted for an electrophotographic apparatus of a so-called digital type utilizing a light beam for image exposure, particularly for an electrophotographic apparatus having an optical system of a high definition, wherein a light beam for image exposure has a spot diameter of 40 μm or less. The present invention effectively prevents the structural interface that is formed when a lower layer and an upper layer are formed respectively by different deposition film forming processes, thereby preventing a small image deletion phenomenon from occurring and providing an electrophotographic image excellent in a dot reproducibility, namely in a gradational property, even when the light beam has a spot diameter of 40 μm or less.

Such light beam is obtained for example from an optical scanning system utilizing a semiconductor laser or a solid-state scanner utilizing an LED or a liquid-crystal shutter, and the light beam generated formed by such system may have various intensity distributions such as Gaussian distribution or Lorentz distribution. In the invention, regardless of intensity distribution, a range in which a light intensity is $1/e^2$ or higher of a peak value in the beam is defined as a spot diameter.

Figure 2:
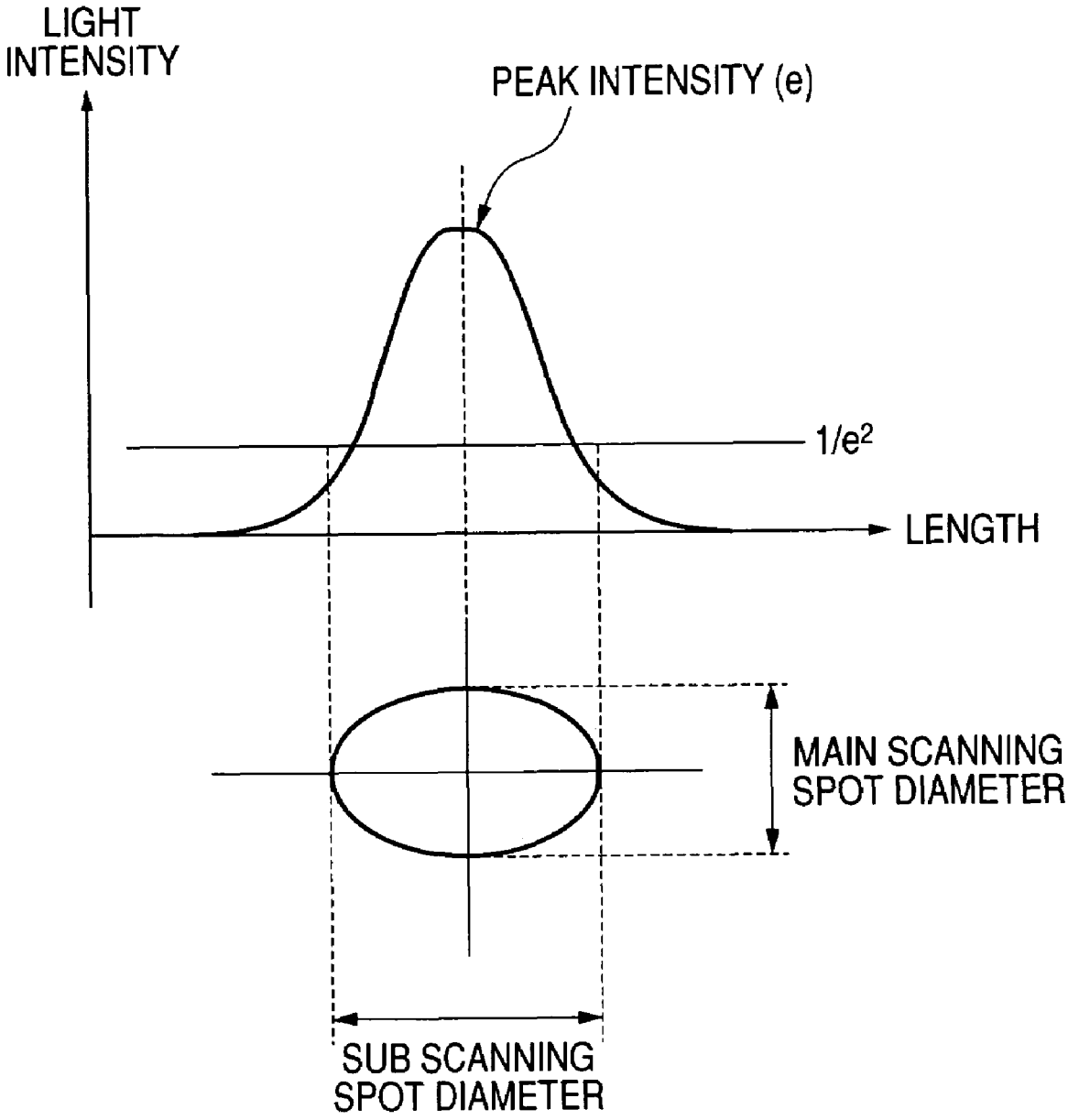
FIG. 2 is a view showing a spot diameter of laser light.

FIG. 2 schematically shows a relationship between light intensity distribution and a spot diameter in a scanning optical system utilizing a semiconductor laser.

In general, a scanning optical system is divided into a main scanning direction scanned by a polygon mirror and a sub scanning direction scanned by rotation of the electrophotographic photosensitive member, so that the spot is supposed to normally have an oval shape in which a main scanning spot diameter is different from a sub scanning spot diameter, as shown in FIG. 2. In the invention, the spot diameter may be any one in both of the directions, but the smaller one is adopted because the influence of the image deletion phenomenon appears more conspicuously in the direction of the smaller spot diameter.

A method for representing a gradation in an electrophotographic apparatus utilizing such semiconductor laser for image exposure includes a density pattern method in which a density pattern is formed by binary control of turning on/off the semiconductor laser, a pulse width modulation (PWM) method in which an intermediate gradation is formed by controlling a laser irradiation time per pixel, and a method of modulating a laser intensity, but the present invention can provide, even in any of these methods, gradational representation with excellent dot reproducibility and high linearity for a light beam of a spot diameter of 40 μm or less.

In the following, a procedure for forming the electrophotographic photosensitive member of the invention will be explained in detail with reference to the accompanying drawings, taking an example of forming the photoconductive layer by a plasma CVD process and the surface layer by a sputtering process.

Figure 3:
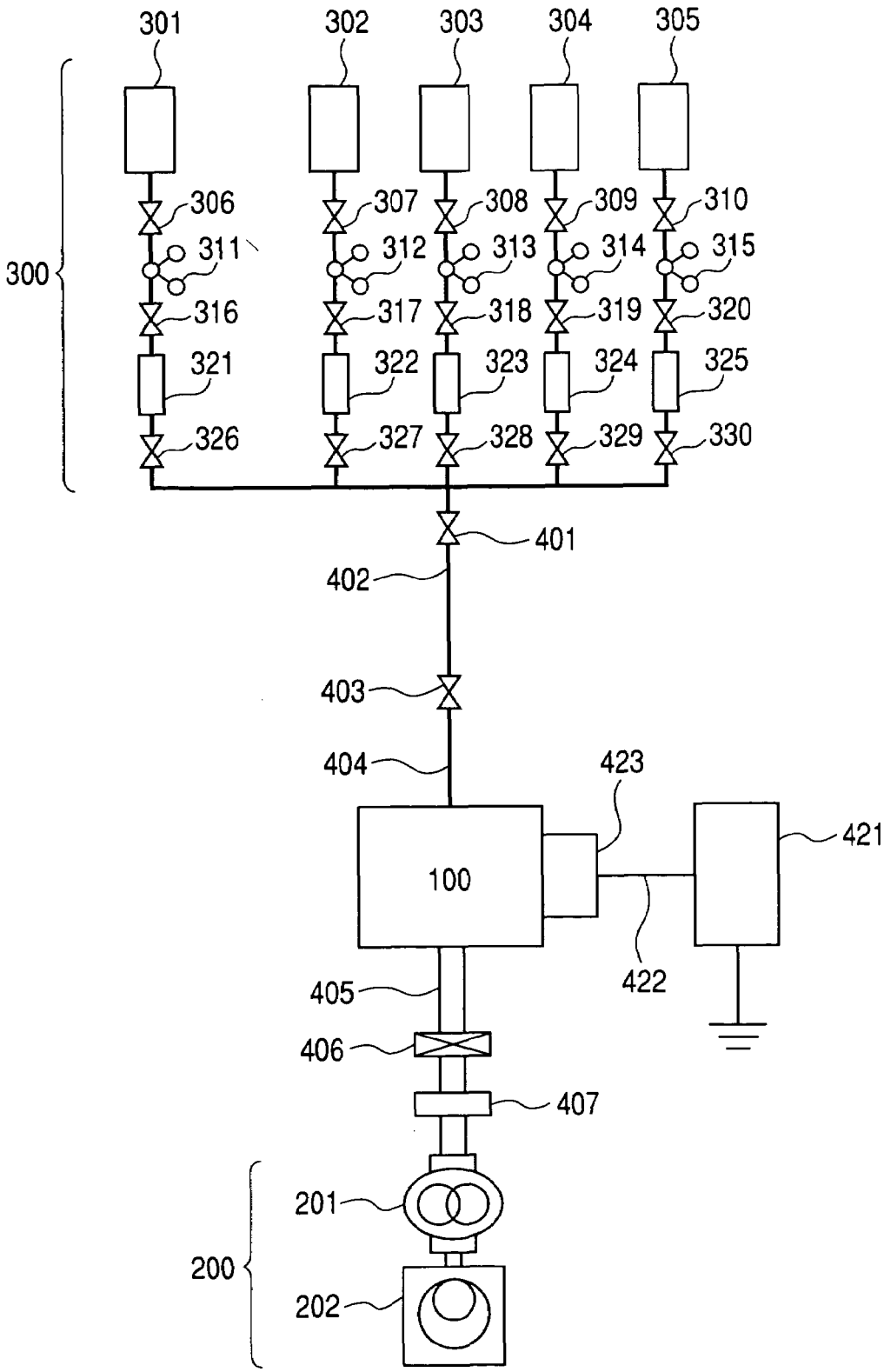
FIG. 3 is a view showing a deposition film forming apparatus.

FIG. 3 is a schematic view of a deposition film forming apparatus by a plasma CVD process, employable as a deposition film forming apparatus of the invention. An apparatus shown in FIG. 3 can be divided into a deposition film forming container 100, an exhaust apparatus 200, and raw material gas supply means 300.

The raw material gas supply means 300 is constituted of gas cylinders 301 to 305, supply valves 306 to 310, pressure regulators 311 to 315, primary valves 316 to 320, mass flow controllers 321 to 325 and secondary valves 326 to 330. The example shown in FIG. 3 is provided with five gas cylinders, but a number thereof can naturally be increased or decreased according to an actual vacuum process. Gasses for vacuum process are contained in the gas cylinders 301 to 305 and are regulated, through the supply valves 306 to 310 and by the pressure regulators 311 to 315, to a pressure for example of about 0.2 MPa. By opening the supply valves 306 to 310, the primary valves 316 to 320 and the secondary valves 326 to 330, the raw material gasses are regulated at desired flow rates respectively by the mass flow controllers 321 to 325 and supplied, through a valve 401, a piping 402, a valve 403 and a gas supply path 404 to the deposition film forming container 100.

The deposition film forming container 100 is further connected through an exhaust pipe 405, a throttle valve 406, and an exhaust valve 407 to an exhaust apparatus 200. The exhaust apparatus 200 is constituted of a mechanical booster pump 201 and a rotary pump 202 and evacuates the interior of the deposition film forming container 100. According to a vacuum level to be used, the exhaust apparatus 200 may further include a fore-pump such as a turbo molecular pump, or an oil diffusion pump.

Figure 4:
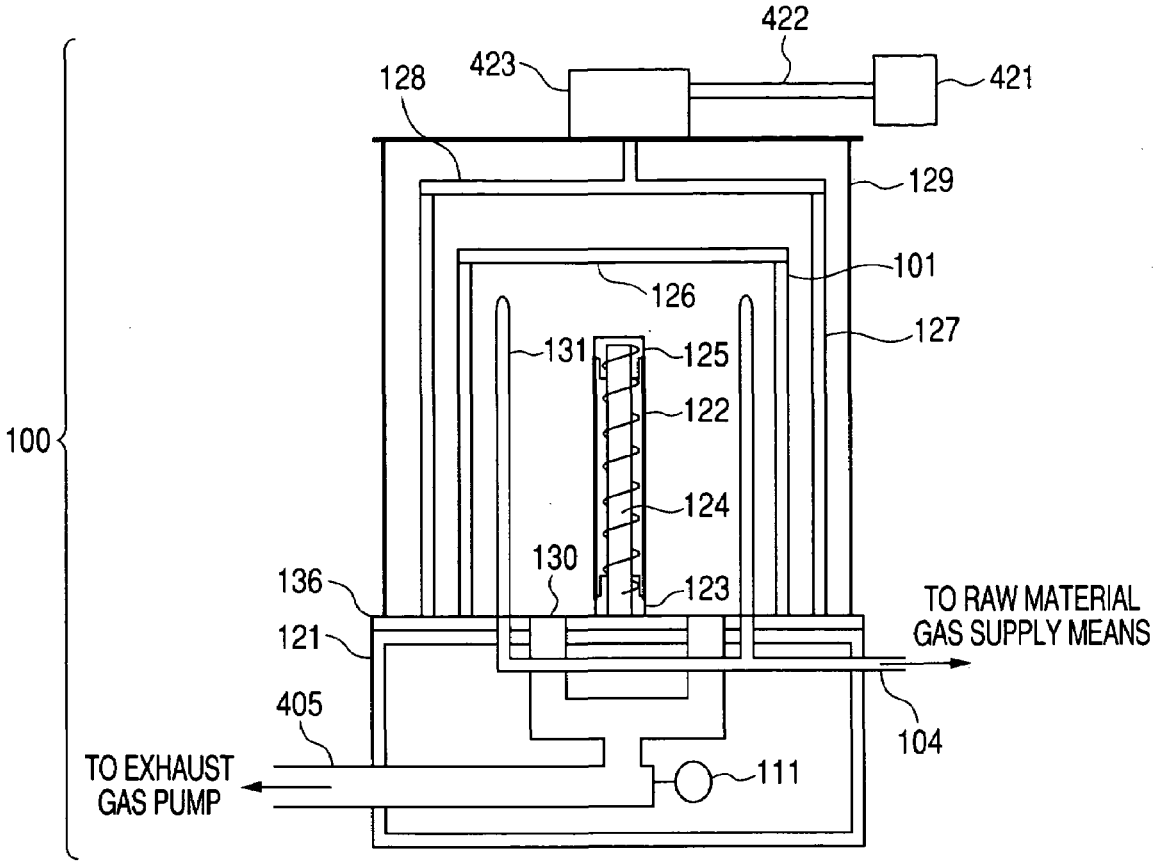
FIG. 4 is a schematic vertical cross-sectional view of a deposition film forming container according to a plasma CVD process.
Figure 5:
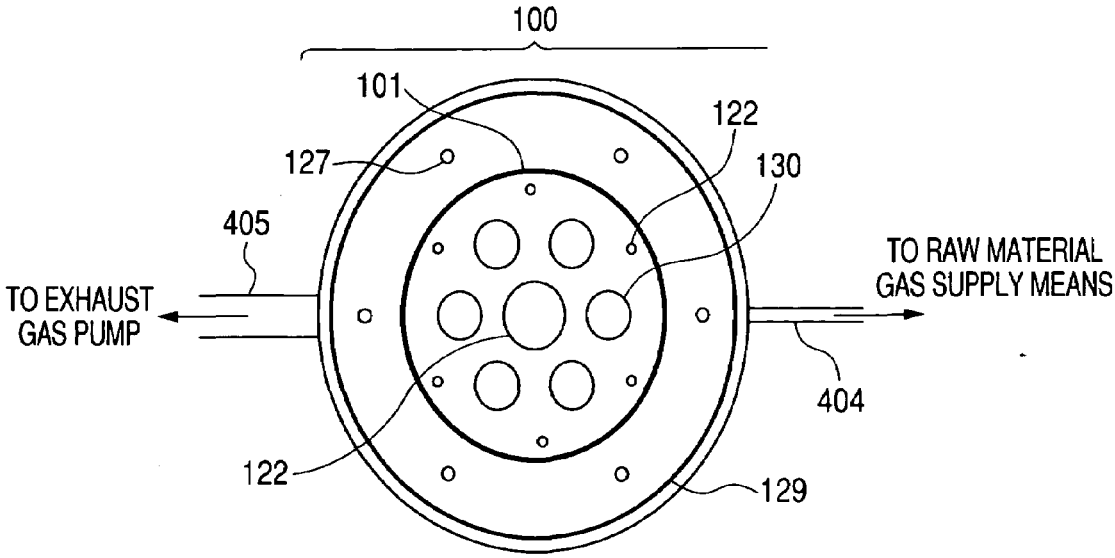
FIG. 5 is a schematic horizontal cross-sectional view of a deposition film forming container according to a plasma CVD process.

FIG. 4 is a schematic vertical cross-sectional view of a deposition film forming container 100 constructed for forming an amorphous silicon photosensitive member on a substrate by a plasma CVD process and usable in the deposition film forming apparatus shown in FIG. 3. FIG. 5 is a schematic horizontal cross-sectional view of the container shown in FIG. 4. The deposition film forming container 100 is provided with a base plate 136 and a vacuum chamber 101 on a rack 121. At an approximate center of the vacuum chamber 101, a support member 123 for supporting a substrate 122 is provided, in which a heater 124 is installed for heating the substrate 122 to a desired temperature. A cap 125 is provided on the substrate in order that the heater 124 inside the substrate 122 is not exposed to plasma. The vacuum chamber 101 is coupled with an upper cover 126 and the base plate 136 by sealing members (not shown), whereby the interior can be sealed in a vacuum state. Around the vacuum chamber 101 and concentrically therewith, plural electrodes 127 are provided and are connected through a branching plate 128 to a matching box 423, which is connected with a high frequency cable 422 to a high frequency power source 421. In the deposition film forming container shown in FIGS. 3 and 4, the vacuum chamber 101 is formed by a ceramic member such as of alumina, which constitutes part of a wall member having a vacuum sealing function. The vacuum chamber 101 has a function of a window member for transmitting a high frequency power, emitted from the electrodes 127, to the interior of the vacuum chamber 101.

The high frequency power, emitted from the electrodes 127, is transmitted to the interior of the vacuum chamber 101 as explained above, and generates a glow discharge in the vacuum chamber 101. Also around the electrodes 127, a high frequency shield 129 is provided for preventing a leakage of the high frequency power to the exterior. The base plate 130 is provided, on a circle having a center approximately at the substrate 122, with exhaust ports 130 which are combined and connected to the exhaust pipe 405. Gas introducing pipes 131 are provided outside the exhaust ports 130 on a circle having a center approximately at the substrate 122, and are connected through the gas supply path 404 to the raw material gas supply means 300. The gas introducing pipes 131 are provided with plural gas emission holes (not shown) and can supply raw material gas into the vacuum chamber 101.

In the following, a procedure of forming a deposition film is explained utilizing the deposition film forming apparatus shown in FIGS. 3 to 5, taking an example of an amorphous silicon electrophotographic photosensitive member.

At first the vacuum chamber 101 is fixed by a seal member (not shown) to the base plate 136 placed on the rack 121, then the substrate 122 degreased and washed in advance is placed by the supporting member 123 in the vacuum chamber 101, also the cap 125 is placed, and the upper cover 126 is placed on the vacuum chamber 101 through a seal member (not shown).

Then the exhaust apparatus 200 is operated and the valve 407 is opened to evacuate the interior of the vacuum chamber 101. In this operation, the throttle valve 406 can be regulated to adjust the exhaust speed in order that dusts in the vacuum chamber 101 do not soar.

When a pressure in the vacuum chamber 101 reaches a predetermined pressure of, for example, 1 Pa or less by an indication of a vacuum gauge 111, the heater 124 is powered to heat the substrate 122 to a desired temperature for example within a range of 50 to 350° C. In this state, an inert gas such as Ar or He can be supplied from the raw material gas supply means 300 to the vacuum chamber 101, thereby executing the heating operation in an inert gas atmosphere.

More specifically, in the case where an inert gas such as Ar is filled in the gas container 301, the supply valve 306, the primary valve 316, the secondary valve 326 and the valves 402, 403 are opened and a mass flow controller 321 is set to supply Ar gas to the vacuum chamber 101 at a desired flow rate.

When the flow rate is stabilized, an aperture of the throttle valve 406 is regulated under confirmation of the indication of the pressure gauge 111, thereby setting the interior of the vacuum chamber 101 at a desired pressure such as about 1 kPa. When the pressure in the container is stabilized, the heater 124 is powered to heat the substrate 122.

When the substrate 122 reaches a desired temperature, the heater 124 is turned off and the supply valve 306, the primary valve 316 and the secondary valve 326 are closed to terminate the supply of Ar gas, and the throttle valve 406 is opened at the same time to evacuate once the interior of the vacuum chamber 101 to a pressure of 1 Pa or less.

Then, gasses to be used for forming a deposition film are supplied from the raw material gas supply means 300 to the vacuum chamber 101. Thus, the supply valves 306 to 310, the primary valves 316 to 320, and the secondary valves 326 to 330 are opened as needed and flow rates are set by the mass flow controllers 321 to 325. When the flow rates of the mass flow controllers are stabilized, the throttle valve 406 is operated while watching the indication of the pressure gauge 111, thereby setting the interior of the vacuum chamber 101 at a desired pressure.

When a desired pressure is established, a high frequency power is applied from the high frequency power source 421 and the matching box 423 is operated to generate a glow discharge in the vacuum chamber 101. Thereafter the high frequency power is adjusted to a desired value to form a deposition film.

When a desired deposition film is formed, the application of the high frequency power is terminated, also the supply valves 306 to 310, the primary valves 316 to 320, the secondary valves 326 to 330 and the valves 402, 403 are closed to terminate the supply of the raw material gasses, and the throttle valve 406 is opened to evacuate the interior of the vacuum chamber 101 to a pressure of 1 Pa or less.

Thus the formation of the deposition film is completed. In the case of forming an electrophotographic photosensitive member of a layer structure shown in FIG. 1, after the lower charge injection blocking layer 12 is formed by the above-described procedure, the photoconductive layer 13 can be formed by repeating the above-described procedure.

It is also possible, after forming the lower charge injection blocking layer 12, to change flow rates and pressures of the raw material gasses to conditions for forming the photoconductive layer within a predetermined time, while maintaining the application of the high frequency power, thereby successively forming the photoconductive layer 13.

After formation of all the deposition films, the interior of the vacuum chamber 101 is evacuated to a pressure of, for example, 1 Pa or less through the aforementioned operation, where it is also possible to execute an operation of purging the interior of the vacuum chamber 101 by intermittently introducing an inert gas from the raw material gas supply means 300. Thereafter a leak valve (not shown) is opened to return the interior of the vacuum chamber 101 to an atmospheric pressure and the substrate 122 is taken out.

Thus, the formation up to the photoconductive layer 13, i.e. the formation of the first area layer 16, is completed, and the process proceeds to the formation of the intermediate layer 14 and the surface layer 15, namely the second area layer 17.

Figure 6:
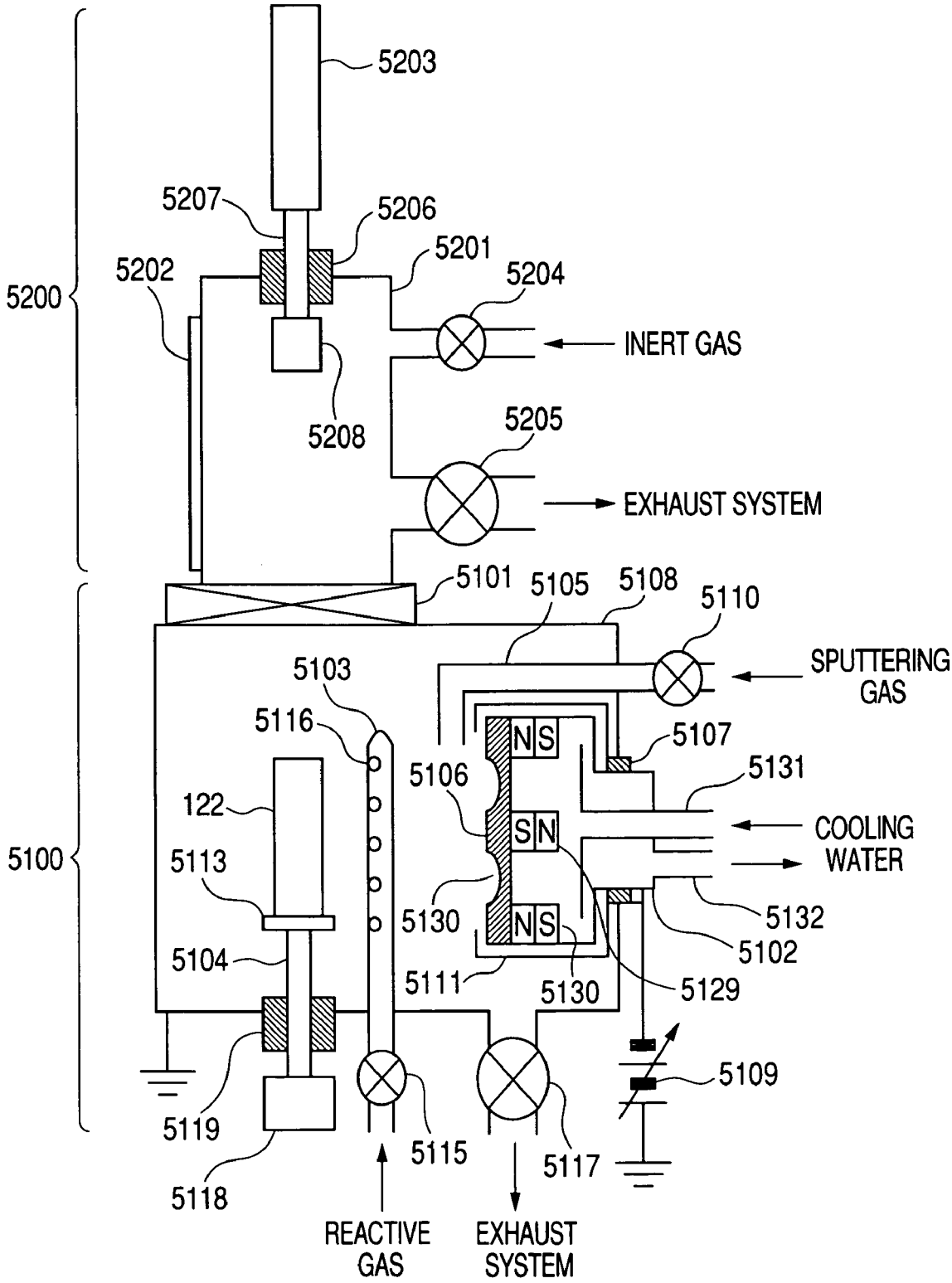
FIG. 6 is a schematic vertical cross-sectional view of a deposition film forming container according to a sputtering process.
Figure 7:
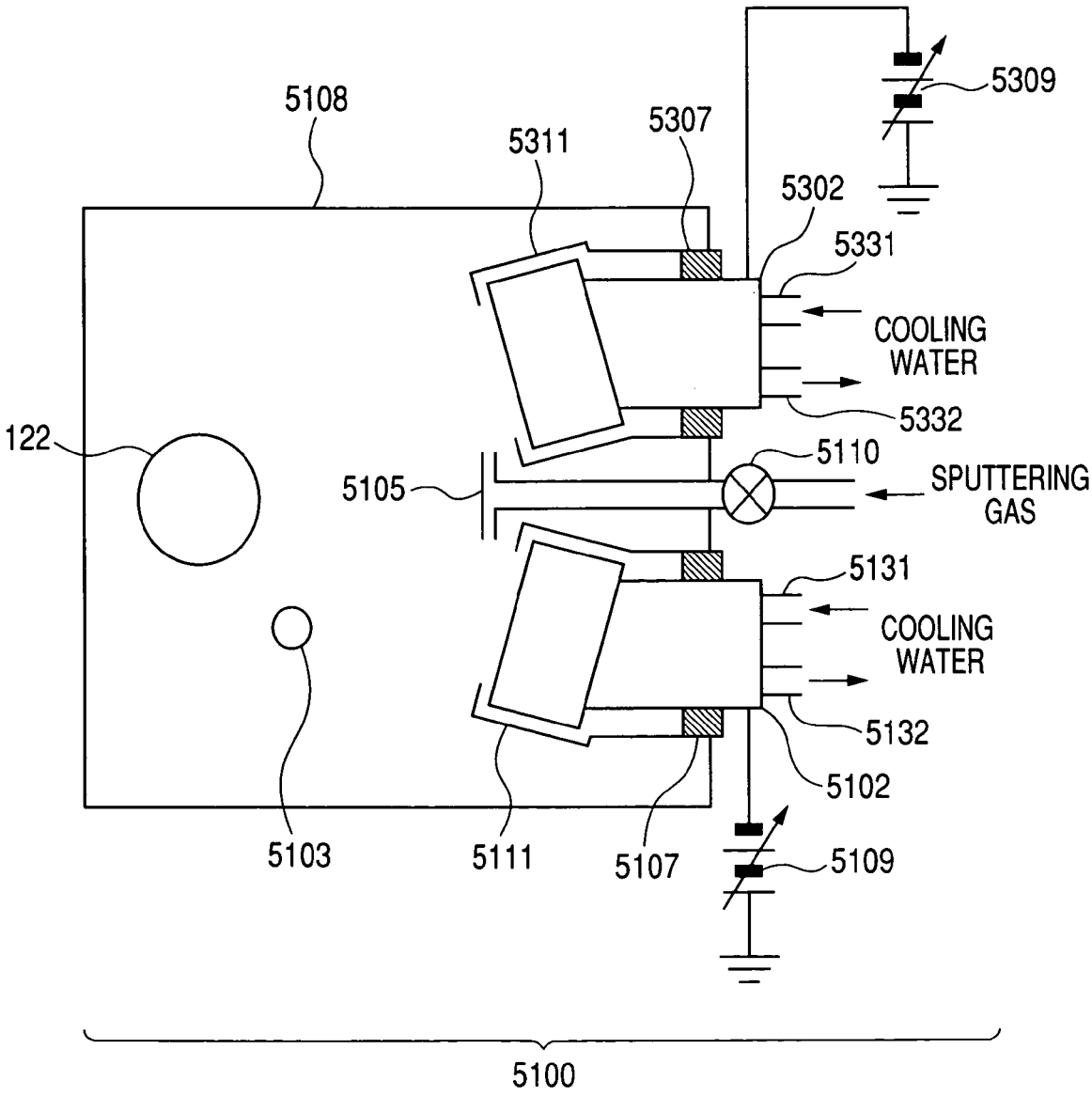
FIG. 7 is a schematic overhead view seen of a deposition film forming container according to a sputtering process.
Figure 8A:
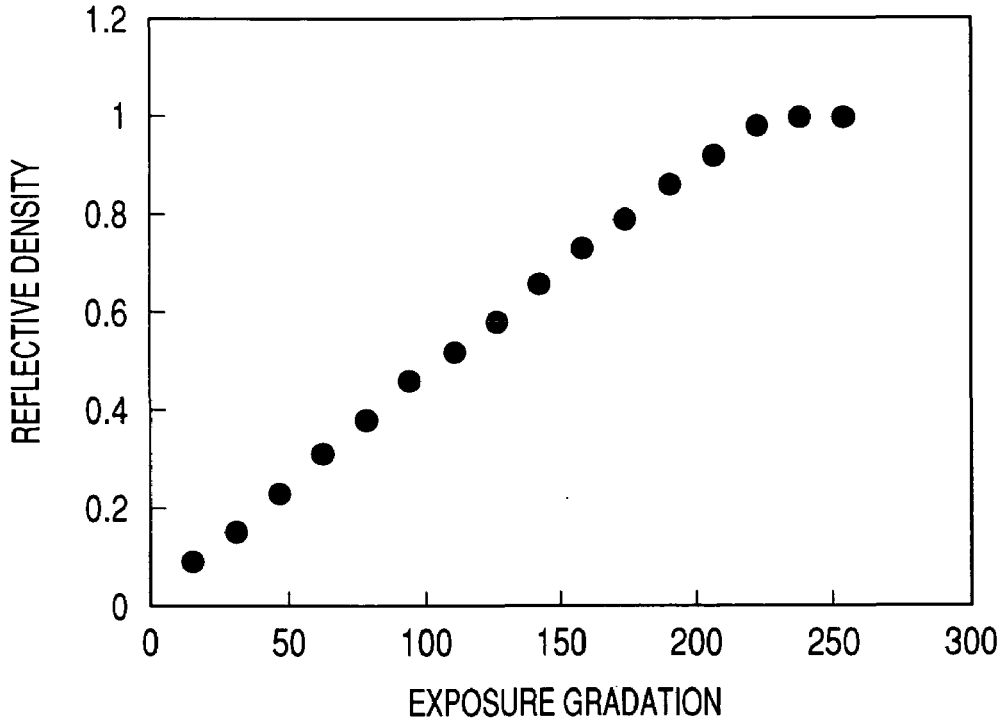
FIG. 8A is a graph showing a relationship between exposure gradation and reflective density.
Figure 8B:
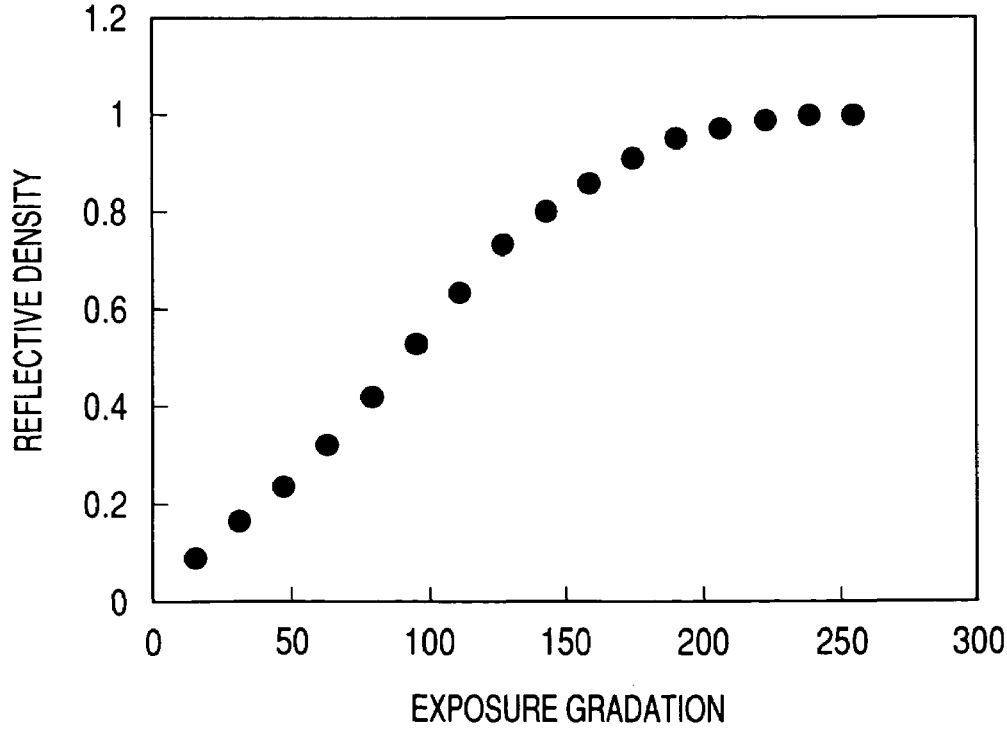
FIG. 8B is a graph showing a relationship between exposure gradation and reflective density.
Figure 8C:
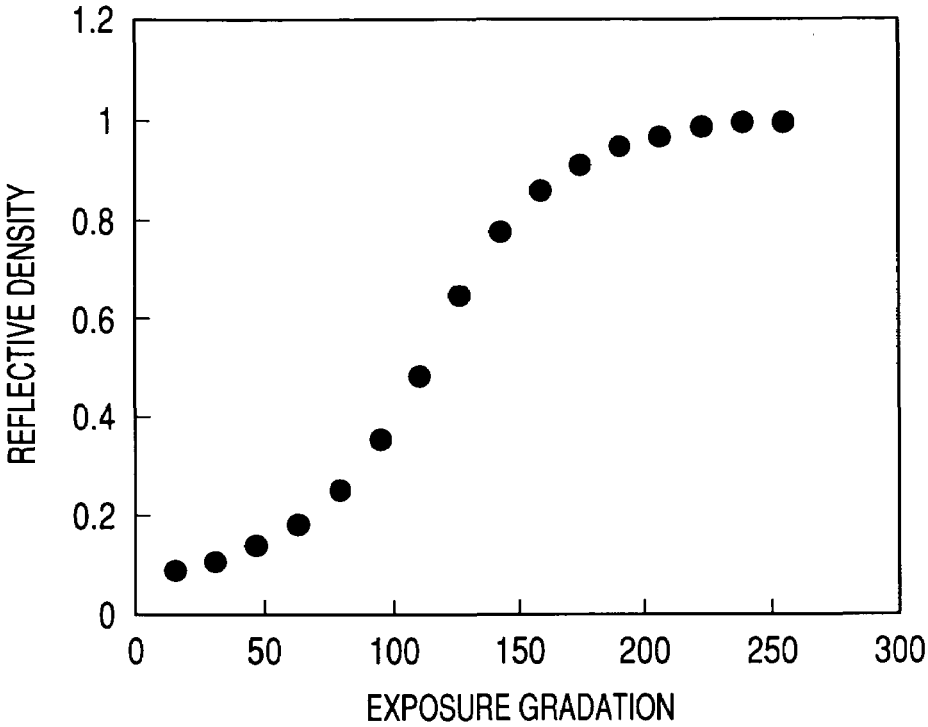
FIG. 8C is a graph showing a relationship between exposure gradation and reflective density.
Figure 8D:
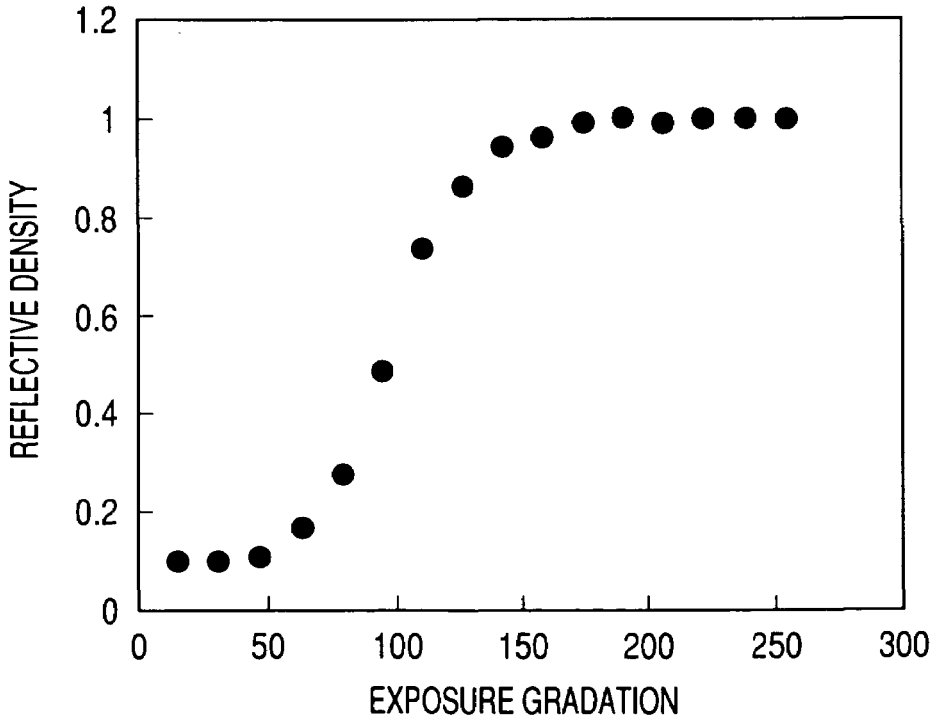
FIG. 8D is a graph showing a relationship between exposure gradation and reflective density.
Figure 9:
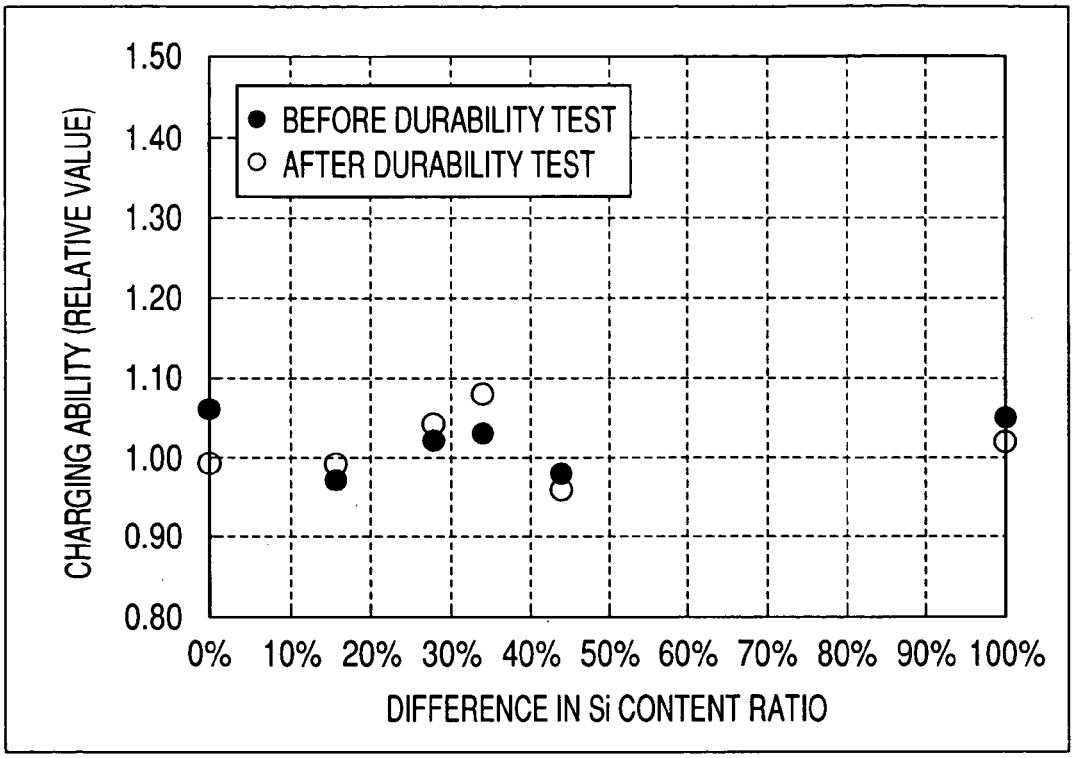
FIG. 9 is a graph showing results on charging ability with a spot diameter 23×32 μm in Table 8.
Figure 10:
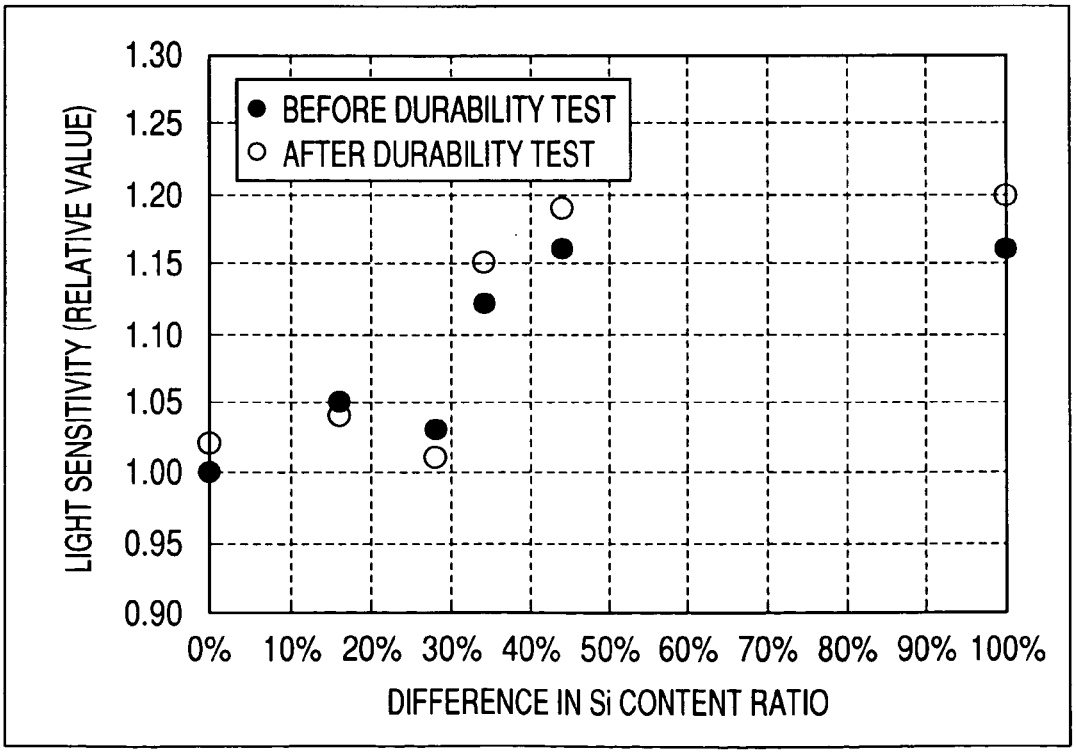
FIG. 10 is a graph showing results on photosensitivity with a spot diameter 23×32 μm in Table 3.
Figure 11:
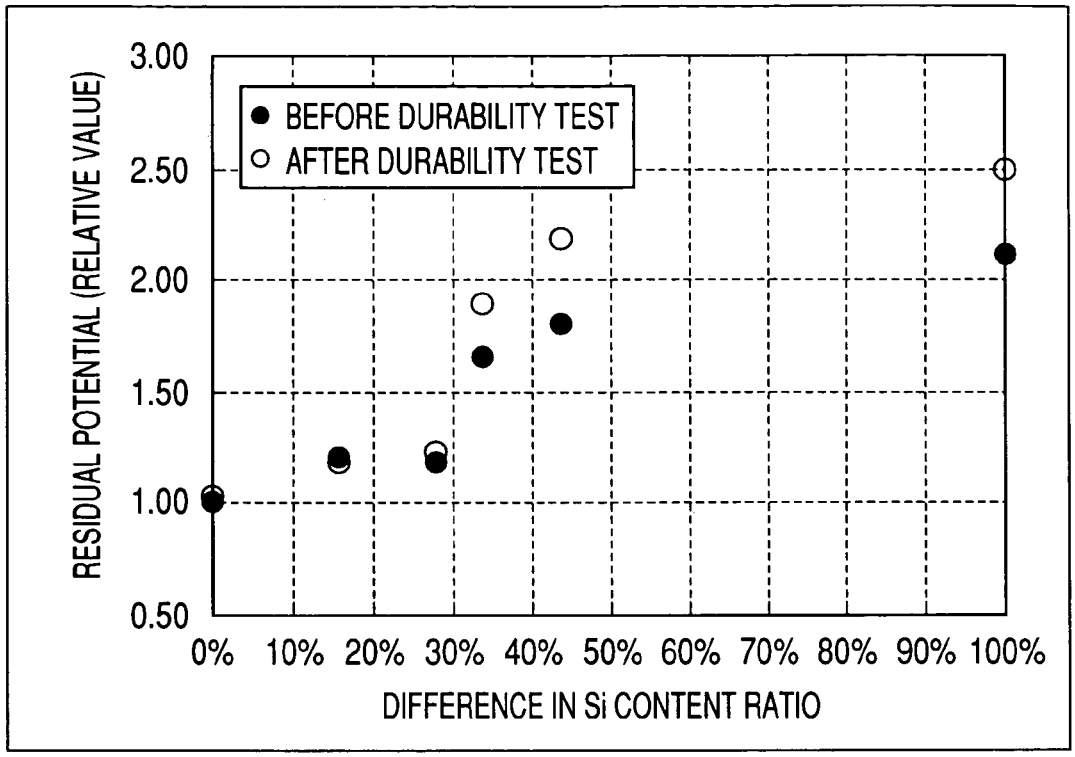
FIG. 11 is a graph showing results on residual potential with a spot diameter 23×32 μm in Table 3.
Figure 12:
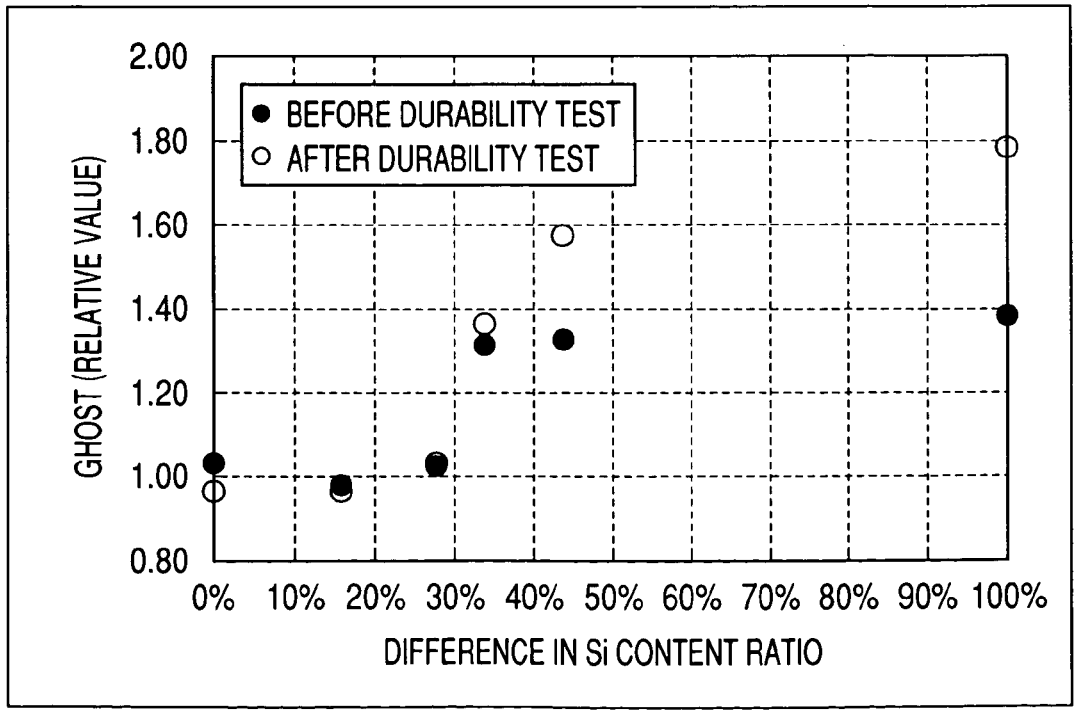
FIG. 12 is a graph showing results on ghost with a spot diameter 23×32 μm in Table 3.

FIGS. 6 and 7 are respectively a lateral cross-sectional view and an upper overhead view, schematically showing a deposition film forming apparatus according to a sputtering process employable in the invention.

The apparatus shown in FIGS. 6 and 7 is principally constituted of a reaction oven 5100 and a charging oven 5200, and the reaction oven 5100 includes a reaction chamber 5108, a reactive gas nozzle 5103, a rotary shaft 5104, a sputtering gas introducing pipe 5105, and cathodes 5102, 5302.

The reaction chamber 4018 is connected through a valve 5117 to an exhaust apparatus (not shown), whereby the interior can be evacuated. The substrate 122 (bearing at least a photoconductive layer formed through the above-described procedure) is installed on the rotary shaft 5104 through a holder 5113, which is supported in a rotatable state by a rotary shaft seal 5119 and is connected with a motor 5118 in the air.

The reactive gas nozzle 5103 is provided with gas emission holes 5116 and is connected through a valve 5115 to raw material gas supply means (not shown). Thus the reactive gas can be supplied from the raw material gas supply means to the vicinity of the substrate 122. The raw material gas supply means can be constructed similar to the raw material gas supply means 300 shown in FIG. 3.

The cathodes 5102, 5302 are supported through insulating members 5107, 5307 by the reaction chamber 5108, and the outer peripheries thereof are separated by shield members 5111, 5311 from plasma. The cathodes 5102, 5302 are opposed to the substrate 122 and can be cooled, in the course of a sputtering process by cooling water supplied from the exterior through cooling water pipes 5131, 5331, 5132, 5332.

The cathodes 5102, 5302 are also connected outside the reaction chamber 5108 respectively to power sources 5109, 5309 and are given respective voltages to generate plasma in the vicinity of the cathodes 5102, 5302. The power sources 5109, 5309 are represented by DC power sources, which are an example and may also be a power source capable of periodically inverting the applied polarity. Also high frequency power sources may be utilized.

The cathode 5102 is provided with a target 5106, and permanent magnets 5129, 5130 are so provided as to form a magnetic field parallel to the target 5106, for executing the so-called magnetron sputtering process.

This process is known to provide a relatively high deposition rate as a highly dense ion region is formed in the vicinity of the surface of the target by the magnetic field. The process is also characterized in forming an erosion area 5133 on the surface of the target 5106, depending on the shape of the magnetic field.

A structure associated with the cathode 5302 is same as that for the cathode 5102 and will not be explained further.

In the vicinity of the cathodes 5102, 5302, a sputtering gas introduction tube 5105 is provided and is connected through a valve 5110 to raw material gas supply means (not shown) for introducing a sputtering gas such as argon (Ar). Also this raw material gas supply means may be constructed in the same manner as in the raw material gas supply means 300 shown in FIG. 3.

The charging oven 5200 is constituted of a vacuum chamber 5201, an actuator 5203 and a door 5202, and the vacuum chamber 5201 communicates with the reaction chamber 5108 through a gate valve 5101. The vacuum chamber 5201 can be evacuated, independently of the reaction chamber 5108, by an exhaust apparatus connected through the valve 5205.

The actuator 5203 has a shaft 5207 which is supported by the vacuum chamber 5201 through a vacuum seal 5206. The shaft 5207 is provided with a chucking mechanism 5208 for supporting the substrate 122 in vacuo, and is extended or contracted in a state that the gate valve 5101 is open and the substrate 122 is conveyed between the reaction oven 5100 and the charging oven 5200.

Also an inert gas can be introduced into the vacuum chamber 5201 through a valve 5204 for ventilating the interior with the inert gas. After ventilating the vacuum chamber 5201, the substrate 122 can be detached from or set on the chucking mechanism 5208 while opening or closing a door 5202.

The apparatus shown in FIGS. 6 and 7 is equipped with plural cathodes and is capable of freely regulating the deposition rates of atoms derived from the targets provided respectively on the cathodes by individually applying electric powers to the respective cathodes, whereby a composition of the deposition film formed on the substrate 122 can be changed in a continuous manner.

In the apparatus shown in FIGS. 6 and 7, a deposition film is formed in the following manner. At first the valve 5117 is opened and the interior of the reaction chamber 5108 is evacuated by the exhaust apparatus. At the same time, the substrate 122, bearing for example the photoconductive layer, is charged into the charging oven 5200 from the door 5202 according to the aforementioned procedure, and is set on the chucking mechanism 5208. Then the door 5202 is closed and the interior of the charging oven 5200 is evacuated while opening the valve 5205.

When the vacuum of the interiors of the reaction chamber 5108 and the charging oven 5200 reaches, for example, $1\times10^{-4}$ Pa or lower, the valve 5101 is opened and the actuator 5203 is operated to extend the shaft 5207, thereby setting the substrate 122 on a holder 5113 in the reaction chamber 5108, and the chucking mechanism 5208 is released to leave the substrate 122 on the holder 5113.

In general, since the sputtering process is more easily influenced by contaminations in comparison with the plasma CVD process, it is preferred, as mentioned above, to apply a higher vacuum level in the sputtering than in the plasma CVD apparatus.

Thereafter the shaft 5207 is retracted to store the chucking mechanism 5208 in the charging oven 5200 and the gate valve 5101 is closed.

Then the valves 5110, 5115 are opened to introduce a sputtering gas and a reactive gas into the reaction chamber 5108 from the raw material gas supply means (not shown), and when a predetermined pressure such as 0.5 Pa is reached by a vacuum gauge (not shown) connected to the reaction chamber 5108, electric powers are applied from the power sources 5109, 5309 to the cathodes 5102, 5302 to generate a glow discharge, where the rotary shaft 5104 is rotated by the motor 5118 to obtain a deposition film uniform in the circumferential direction of the substrate 122.

When a desired deposition film is formed, the power supply from the power sources 5109, 5309 to the cathodes 5102, 5302 is terminated to complete the formation of the deposition film.

At the same time, the valves 5110, 5115 are closed to terminate the supply of the reactive gas and the sputtering gas, then the interior of the reaction chamber 5108 is once evacuated to a pressure of $1\times10^{-4}$ Pa or less and the gate valve 5101 is opened.

Then the actuator 5203 is operated to extend the shaft 5207 and to hold the substrate 122 by the chucking mechanism 5208, then the shaft 5207 is retracted to store the substrate 122 in the charging oven 5200 and the gate valve 5101 is closed.

When the closing of the gate valve 5101 is confirmed, the valve 5204 is opened to ventilate the interior of the vacuum chamber 5201, then the door 5202 is opened and the substrate 122 is taken out whereby the formation of the electrophotographic photosensitive member is completed.

In the afore-mentioned procedure for forming the deposition film forming process, the deposition film forming member prepared by the plasma CVD process in the deposition film forming apparatus shown in FIGS. 3 to 5 is taken out once into the air and then charged in the deposition film forming apparatus for the sputtering process as shown in FIGS. 6 and 7, but such procedure is not restrictive and there may be provided, for example, a conveying apparatus capable of conveyance in vacuum between both apparatuses, thereby conveying the electrophotographic photosensitive member in vacuum.

In the following, the present invention will be described more specifically by giving experimental examples and working examples.

EXAMPLE 1 AND COMPARATIVE EXAMPLE 1

An electrophotographic photosensitive member of a layer structure shown in FIG. 1, employing magnesium fluoride as a surface layer, was prepared by forming a lower charge injection blocking layer and a photoconductive layer, namely a first area layer, by a plasma CVD process, and then by forming an intermediate layer and a surface layer, namely a second area layer, by a sputtering process. The plasma CVD process was conducted using the apparatus shown in FIGS. 3 to 5 and the sputtering process was conducted using the apparatus shown in FIGS. 6 and 7, according to the above-described procedures. In the sputtering process, RF power sources having a frequency of 13.56 MHz were utilized.

In the present example, a mirror-finished aluminum cylinder of an external diameter (Φ) of 80 mm, a length of 358 mm and a thickness of 3 mm was employed as the substrate, and the lower charge injection blocking layer and the photoconductive layer were formed under conditions shown in Table 1, and the intermediate layer and the surface layer were formed under conditions shown in Table 2. Also a high frequency power in a VHF region, having a frequency of 105 MHz, was employed.

In the present example, the intermediate layer was formed from silicon and magnesium targets, and the content ratio of silicon and magnesium at the surface of the intermediate layer on the photoconductive layer side was adjusted by changing the electric power supplied to the magnesium target within a range of 0-700 W at the initial stage of formation of the intermediate layer. During the formation of the intermediate layer, electric powers applied to the targets and gas flow rates were so regulated as to continuously change the composition in such a manner that the composition of the intermediate layer at its surface on the surface layer side became approximately the same as the composition of the surface layer.

TABLE 1

| | First area layer | |
|---|---|---|
| Gas flow rate | lower charge injection blocking layer | photoconductive layer |
| $SiH_4$ [ml/min (normal)] | 100 | 150 |
| $B_2H_6$ (ppm) (to $SiH_4$) | 1000 | 1.5 |
| $CH_4$ [ml/min (normal)] | 300 | 0 |
| Pressure [Pa] | 1 | 1 |
| High frequency power [W] | 500 | 2000 |
| Substrate temperature [° C.] | 210 | 230 |
| Layer thickness [μm] | 3 | 28 |

TABLE 2

| | Intermediate layer | Second area layer Surface layer |
|---|---|---|
| Gas flow rate | | |
| Ar [ml/min (normal)] | 200 | 200 |
| $H_2$ [ml/min (normal)] | 20 | 20 |
| $F_2$ [ml/min (normal)] | variable (0-15) → 10 | 10 |
| Pressure [Pa] | 0.5 | 0.5 |
| RF power [W] | | |
| silicon target | 500 → 0 | 0 |
| magnesium target | variable (0-700) → 500 | 500 |
| Substrate temperature [° C.] | room temp. | room temp. |
| Layer thickness [μm] | 0.3 | 0.5 |

In the table, "→" indicates that each element is changed between values in front and back. In the formation of the intermediate layer and the surface layer, Ar was supplied from the sputtering gas supply tube 5105, and other gasses were supplied from the reactive gas supplying nozzle 5103.

Also the flow rate of $F_2$ was experimentally determined in advance in such a manner that a ratio of Mg and F was allowed to be 1:2 by the electric power supplied to the magnesium target, and was changed according to such experimental values.

The electrophotographic photosensitive member thus prepared was mounted on a modified digital copying machine (iR6000, manufactured by Canon Inc.). The copying machine was modified by changing the cleaning roller from a magnet roller to an urethane rubber sponge roller in such a manner that the sponge roller was brought into contact with the photosensitive member having a nip width of 5 mm and was rotated in the forward direction with respect to the rotation of the photosensitive member, with a peripheral speed difference of 120%.

(Charging Ability)

The electrophotographic photosensitive member was mounted on the copying machine, and with an image exposure (laser exposure) turned off, a high voltage of +6 kV was applied to a charging device to conduct a corona charging. A surface potential (namely dark charging potential) generated on the electrophotographic photosensitive member was measured by a surface potential meter (Model 1334, manufacture by TREK Co.), installed in a position corresponding to a developing device.

The charging ability is evaluated better for a larger value.

(Photosensitivity)

The electrophotographic photosensitive member was installed in the aforementioned copying machine, and a charging current supplied to the charger was so regulated that a dark charging potential in a position of a developing device became 450 V.

An image exposure (laser exposure) was conducted while the aforementioned charging current was maintained, and a laser intensity was so regulated that a light surface potential at the position of the developing device became 50 V. A photosensitivity was defined by the laser intensity in such a state.

The photosensitivity is evaluated better for a smaller value.

(Residual Potential)

The dark surface potential of the electrophotographic photosensitive member at the position of the developing device was regulated to 450 V as in the photosensitivity, then a strong laser exposure (for example 1.2 $\mu J/cm^2$) was given and a light surface potential was taken as a residual potential.

The residual potential is evaluated better for a smaller value.

(Ghost)

The dark surface potential of the electrophotographic photosensitive member was adjusted to 450 V as in the photosensitivity. Then a test chart, prepared by adhering black circles having a reflective density of 1.1 and a diameter of 5 mm on a Canon ghost test chart, was placed on the end portion of an original supporting glass, then a Canon halftone test chart was placed thereon and a copy image was produced. On the halftone image thus obtained, a difference in the reflective density was measured between a ghost portion of a diameter of 5 mm in the ghost chart and an halftone portion. The reflective density was measured with a densitometer D220-II manufactured by Gretag Macbeth Inc.

The test result on a ghost is evaluated better for a smaller value.

(Gradation)

The dark surface potential of the electrophotographic photosensitive member was adjusted to 450 V as in the photosensitivity, and gray tones of 256 gradation levels were outputted by a PWM method to form a copy image. The PWM method was conducted by a known method described for example in Japanese Patent Application Laid-open No. H11-198453.

On the image thus obtained, a reflective density was measured at every 16 gradation levels as in the aforementioned ghost measuring method, and a relationship between the gradation level and the reflective density was investigated.

The resulting relationship of the gradation level and the reflective density was compared with graphs shown in FIGS. 8A to 8D and an evaluation was made in the following manner:

A. The same level as FIG. 8A or more linear (very satisfactory gradation);

B. A range in which a deviation from linearity is larger than FIG. 8A and the same level as FIG. 8B (gradation inferior to A, but difference unclear on image);

C. A range in which a deviation from linearity is larger than FIG. 8B and the same level as FIG. 8C (gradation inferior to B, but difference unclear on image, and practically acceptable);

D. A range in which a deviation from linearity is larger than in FIG. 8C and the same level as FIG. 8D (gradation inferior to C and practically unacceptable);

E. A deviation from linearity is larger than FIG. 8D (gradation further inferior to D and totally unsuitable for gradational representation).

In FIGS. 8A to 8D, the reflective density was obtained by measuring five optional points of the same gradation level and averaging the measured values, and represented by a normalized value, taking as one (1) the largest value found by subtracting a reflective density of a white copying paper from the reflective density of each gradation level. In the foregoing evaluation, A, or the linear gradation shown in FIG. 8A, best represents gradation.

The aforementioned evaluation was conducted with an image exposing laser of an oscillation wavelength of 405 nm, and with three spot diameters of (1) 60×60 μm, (2) 40×60 μm and (3) 23×35 μm (each representing a main-scanning spot diameter×a sub-scanning spot diameter). Such evaluation was conducted immediately after the preparation of the electrophotographic photosensitive member and again after a durability test in which a Canon test chart NA-7 was placed on the original supporting glass of the aforementioned copying machine and image formation was repeated on 100,000 sheets in an environment of 30° C. and 80% RH.

In addition to the aforementioned evaluation of the electrophotographic photosensitive member, for the surface layer, a sample was prepared in which a single layer was formed as the surface layer on a glass substrate (#7059 manufactured by Corning Glass Co., with a size of 25.4×12.7 mm and a thickness of 1 mm) under the same conditions same as those shown in Table 2.

The sample was subjected to a measurement of a dynamic hardness under the following conditions.

(Dynamic Hardness)

The sample was mounted on a dynamic hardness meter DUH-201, manufactured by Shimadzu Ltd., and a load was directly applied to a triangular pyramid diamond stylus of a tip radius of 0.1 μm or less and a ridgeline angle of 115°, and a relationship of the load and a push-in depth was determined according to the following equation for a push-in depth of 0.1 μm:

$$DH=\alpha\times p/d^2$$

(α:37.8, p: load (gf; 1 gf=9.8 mN), and d: push-in depth (μm)). The measurement was conducted with a load rate of 0.142 mN/s (=0.0145 gf/s) and an average value was obtained by measuring five optional points on the sample and averaging the resulting values.

The dynamic hardness is better for a larger value.

Evaluation was conducted by taking, among the electrophotographic photosensitive members thus prepared, one having a difference within ±30% between the content ratio of silicon as the principal constituent element in the photoconductive layer (having a silicon content ratio of about 100% (excluding hydrogen)) and the content ratio of silicon at the surface of the intermediate layer on the photoconductive layer side as Example 1, and one having a difference exceeding 30% as Comparative Example 1.

The content ratio was measured with SIMS (CAMECA ims-4f), using, for the photoconductive layer, a sample prepared under the same conditions as those for the photoconductive layer on a silicon wafer of a size of 25.4×12.7 mm and a thickness of 1 mm, and using, for the surface of the intermediate layer on the photoconductive layer side, a sample prepared with a constant thickness of 1 μm under the same conditions as the initial forming conditions for the intermediate layer on an aforementioned silicon wafer.

COMPARATIVE EXAMPLE 2

A first area layer was formed in the same manner as Example 1 under the conditions shown in Table 1, and without an intermediate layer, a surface layer of magnesium fluoride was prepared under conditions for forming a second area layer shown in Table 2. Electrophotographic photosensitive members thus prepared were evaluated in the same manner as in Example 1 and Comparative Example 1.

Results in Example 1, Comparative Examples 1 and 2 are shown in Table 3.

In Table 3, the results of charging ability, photosensitivity, residual potential and ghost are each represented by a relative value, taking as 1.00 a value in Example 1 with a silicon content ratio difference of 0% before the durability test.

As to the photosensitivity, a value of 1.20 or less is practically acceptable for the electrophotographic photosensitive member, and a value of 1.10 or less shows satisfactory characteristics for wide conditions of use.

As to the residual potential, a value of 3.00 or less is practically acceptable, and a value of 1.50 or less shows satisfactory characteristics for wide conditions of use.

As to the ghost, a value of 2.00 or less is practically acceptable, and a value of 1.20 or less shows satisfactory characteristics not recognizable on the image in most cases.

Based on the results shown in Table 3, the electrophotographic photosensitive member of the invention provides very satisfactory results on all the characteristics. On the other hand, an increase in the difference between the content ratio of silicon which is the principal constituent element of the photoconductive layer and the content ratio of silicon at the surface of the intermediate layer on the photoconductive layer side resulted in gradual deteriorations in the photosensitivity, residual potential, ghost and gradation characteristics, and such deteriorations were further increased by the durability test. Also evident deteriorations in the gradation characteristics and the ghost were observed with a decrease in the spot diameter of the image exposing laser. The reason therefor is considered to be that the ghost becomes more noticeable by deterioration in the gradation characteristics.

The results on the charging ability, photosensitivity, residual potential and ghost in different silicon content ratios in Table 3 with a spot diameter (3) (23 μm×32 μm) are shown respectively in FIGS. 9, 10, 11 and 12. A smaller difference between the content ratio of silicon which is the principal constituent element of the photoconductive layer and the content ratio of silicon at the surface of the inter-

TABLE 3

| | Difference in silicon content ratio | Spot diameter | Charging ability | Photo-sensitivity | Residual potential | Ghost | Gradation |
|---|---|---|---|---|---|---|---|
| Ex. 1 | 0% | (1) (60 × 60 μm) | 1.00/0.96 | 1.00/1.02 | 1.00/0.98 | 1.00/0.98 | A/A |
| | | (2) (40 × 60 μm) | 0.98/1.02 | 0.96/0.98 | 1.02/0.95 | 0.96/0.96 | A/A |
| | | (3) (23 × 35 μm) | 1.06/0.99 | 1.00/1.02 | 1.00/1.02 | 1.03/0.96 | A/A |
| | 16% | (1) (60 × 60 μm) | 0.98/0.98 | 1.03/1.05 | 1.20/1.20 | 1.00/1.00 | A/A |
| | | (2) (40 × 60 μm) | 0.99/0.98 | 1.02/1.00 | 1.18/1.20 | 1.02/0.95 | A/A |
| | | (3) (23 × 35 μm) | 0.97/0.99 | 1.05/1.04 | 1.20/1.18 | 0.98/0.96 | A/A |
| | 28% | (1) (60 × 60 μm) | 1.03/1.05 | 1.01/1.02 | 1.15/1.15 | 0.98/1.02 | A/A |
| | | (2) (40 × 60 μm) | 1.02/1.02 | 0.98/0.96 | 1.16/1.18 | 0.98/1.00 | A/A |
| | | (3) (23 × 35 μm) | 1.02/1.04 | 1.03/1.01 | 1.18/1.22 | 1.02/1.03 | A/B |
| Comp. Ex. 1 | 34% | (1) (60 × 60 μm) | 1.03/1.02 | 1.12/1.22 | 1.60/1.81 | 1.13/1.19 | A/A |
| | | (2) (40 × 60 μm) | 1.02/1.03 | 1.12/1.20 | 1.68/1.90 | 1.18/1.26 | B/C |
| | | (3) (23 × 35 μm) | 1.03/1.08 | 1.12/1.15 | 1.65/1.89 | 1.31/1.36 | B/C |
| | 44% | (1) (60 × 60 μm) | 0.98/1.01 | 1.16/1.19 | 1.80/2.15 | 1.18/1.25 | A/A |
| | | (2) (40 × 60 μm) | 1.03/1.05 | 1.15/1.19 | 1.83/2.09 | 1.25/1.49 | B/C |
| | | (3) (23 × 35 μm) | 0.98/0.96 | 1.16/1.19 | 1.80/2.18 | 1.32/1.57 | B/C |
| Comp. Ex. 2 | 100% (no intermediate layer) | (1) (60 × 60 μm) | 1.02/1.03 | 1.13/1.17 | 2.13/2.43 | 1.20/1.27 | A/A |
| | | (2) (40 × 60 μm) | 1.02/1.05 | 1.15/1.18 | 2.10/2.45 | 1.28/1.58 | B/C |
| | | (3) (23 × 35 μm) | 1.05/1.02 | 1.16/1.20 | 2.10/2.49 | 1.38/1.78 | B/C |

(before durability test/after durability test)

mediate layer on the photoconductive layer side can prevent the electrophotographic properties ascribable to the interface from deteriorating, and based on the results shown in FIGS. 9, 10, 11 and 12, a threshold value of such difference is supposed to be in the range of ±30%.

The surface layer of magnesium fluoride employed in the present Example and Comparative Examples had a dynamic hardness of 9.83 kN/mm$^2$ (=1003 kgf/mm$^2$), which was sufficient for the surface layer.

EXAMPLE 2 And COMPARATIVE EXAMPLE 3

Figure 13:
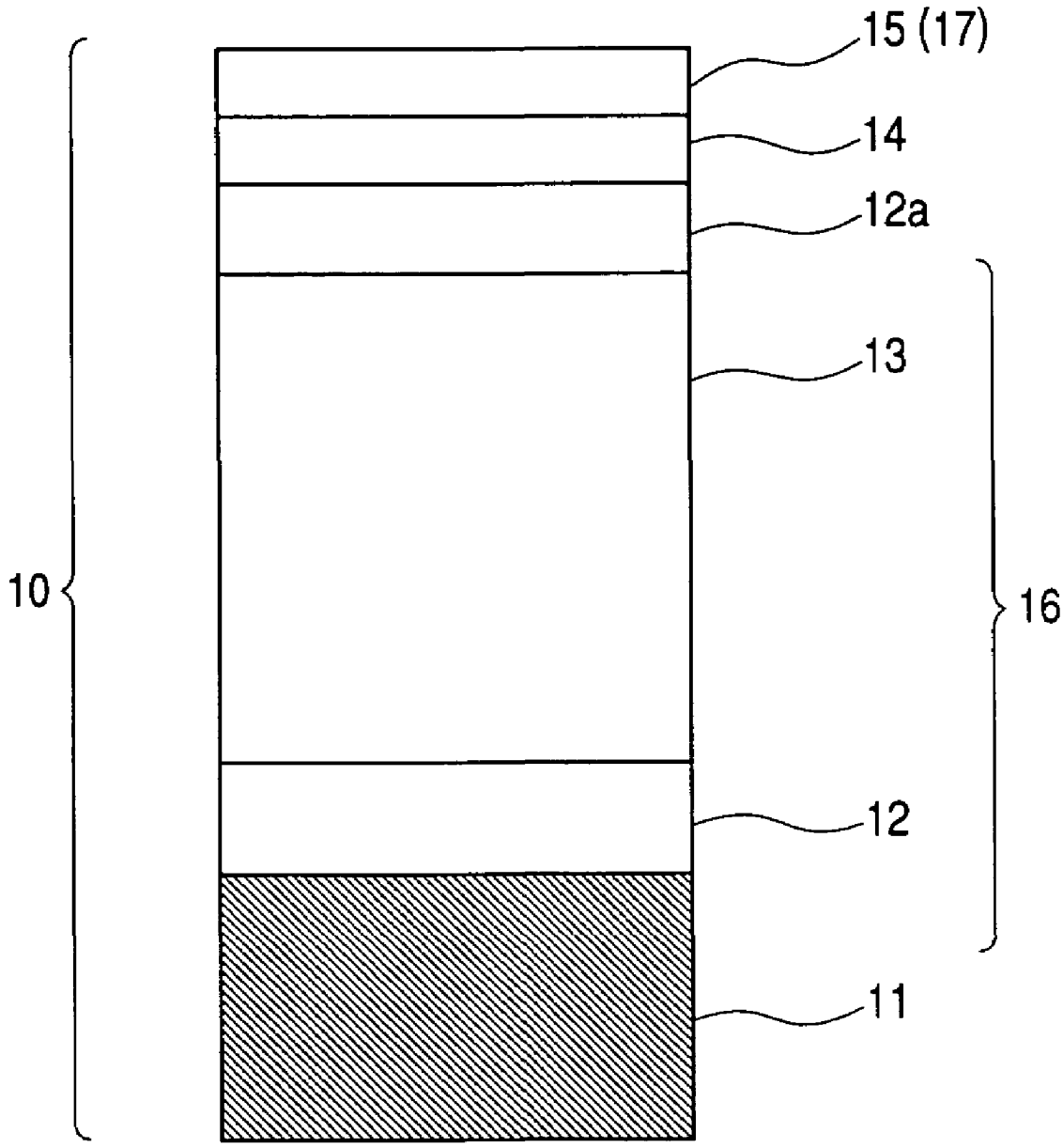
FIG. 13 is a view showing a layer structure of an electrophotographic photosensitive member.
Figure 14:
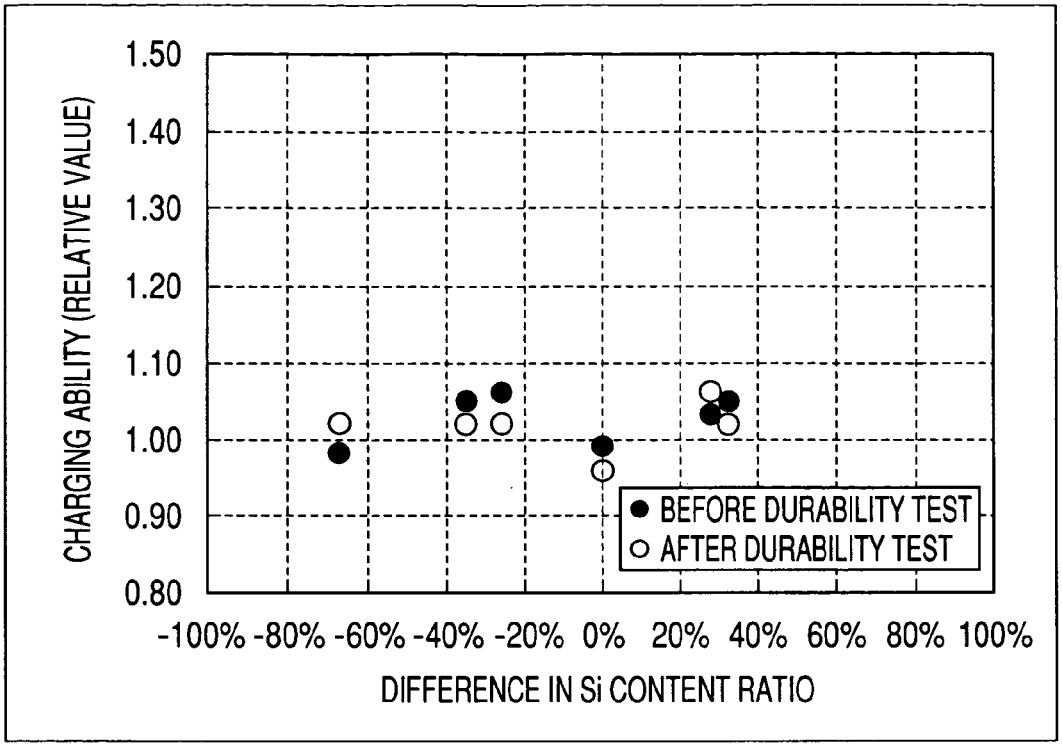
FIG. 14 is a graph showing results on charging ability in Table 8.
Figure 15:
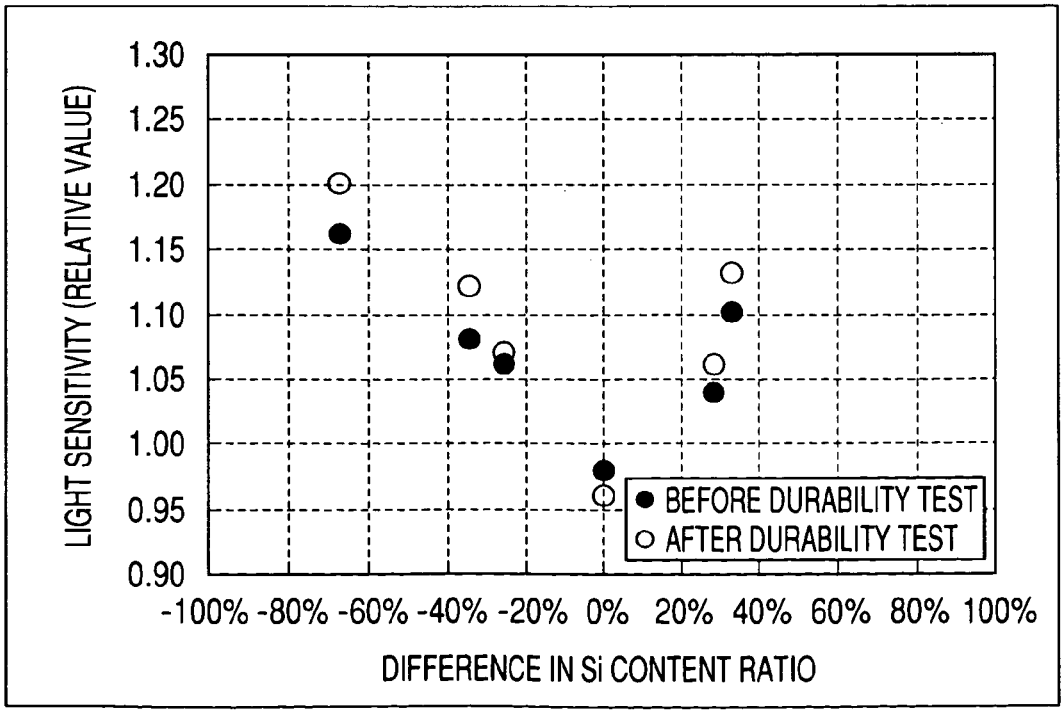
FIG. 15 is a graph showing results on photosensitivity in Table 8.
Figure 16:
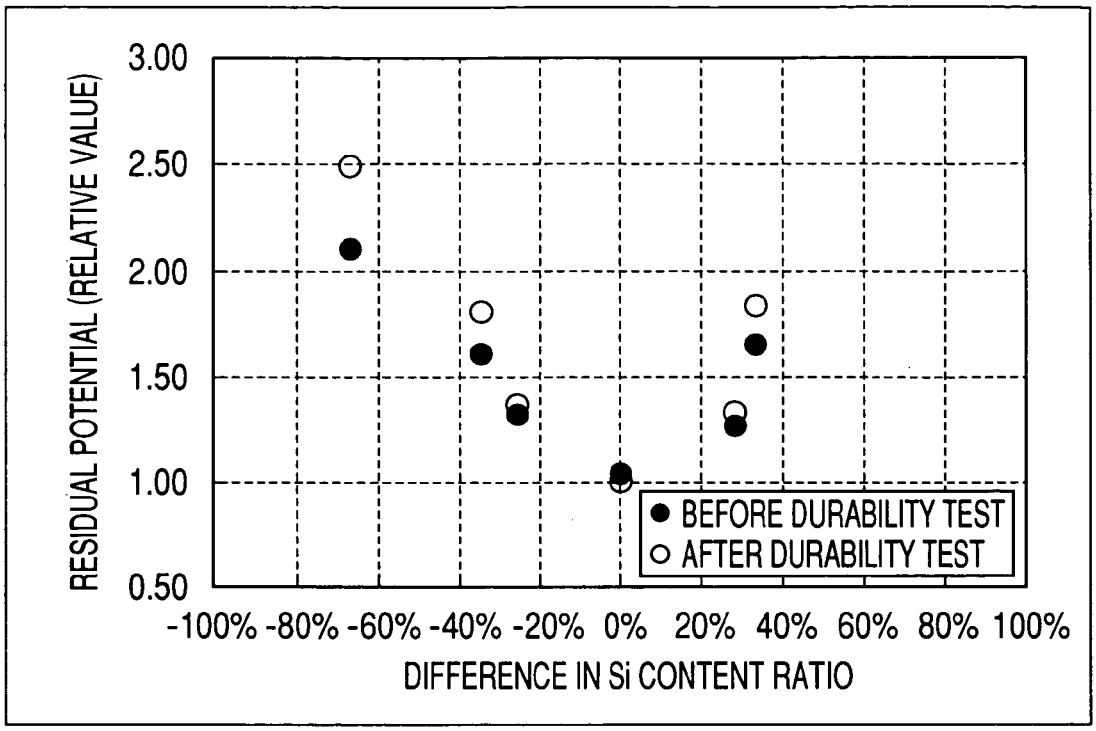
FIG. 16 is a graph showing results on residual potential in Table 8.
Figure 17:
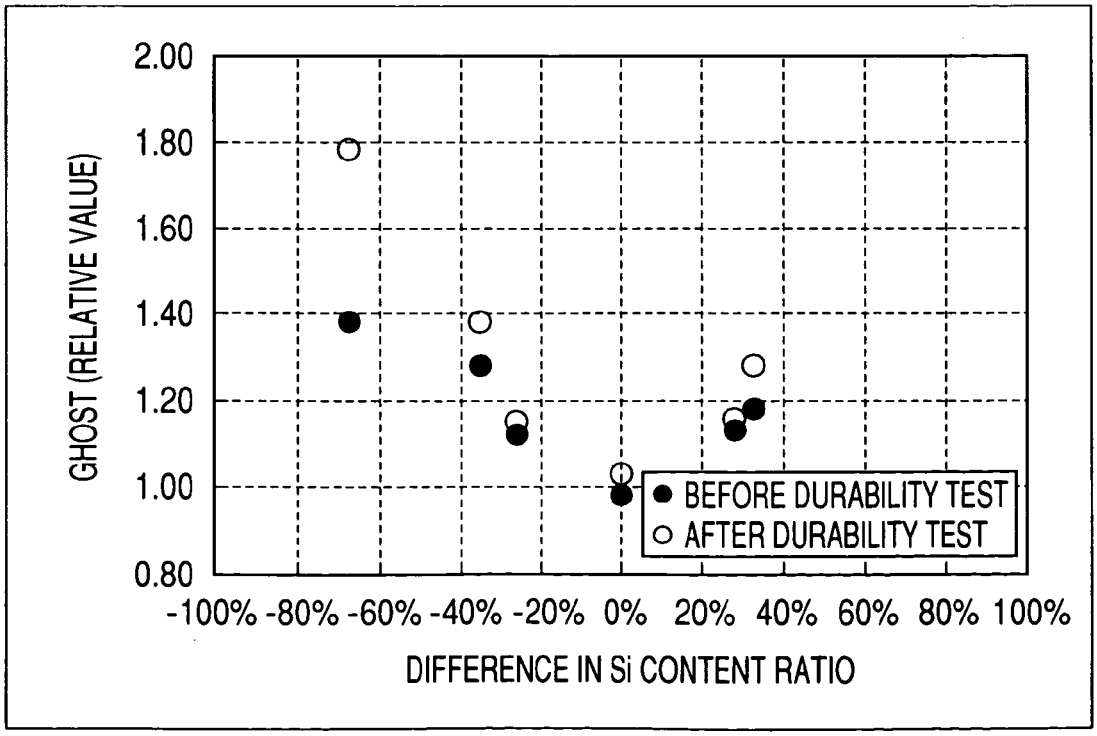
FIG. 17 is a graph showing results on ghost in Table 8.

An electrophotographic photosensitive member having a layer structure as shown in FIG. 13 was prepared, employing magnesium fluoride as a surface layer. Referring to FIG. 13, an electrophotographic photosensitive member 10 is prepared by forming, on a conductive substrate 11, in succession a lower charge injection blocking layer 12, a photoconductive layer 13, an upper charge injection blocking layer 12*a*, an intermediate layer 14, and a surface layer 15, wherein the lower charge injection blocking layer 12, the photoconductive layer 13 and the upper charge injection blocking layer 12*a* constitute a first area layer, and the surface layer 15 constitutes a second area layer.

In this electrophotographic photosensitive member, the lower charge injection blocking layer 12, the photoconductive layer 13 and the upper charge injection blocking layer 12*a*, or the first area layer, were formed by a plasma CVD process, and the intermediate layer and the surface layer, or the second area layer, were formed by a sputtering process. The plasma CVD process was conducted using the apparatus shown in FIGS. 3 to 5 and the sputtering process was conducted using the apparatus shown in FIGS. 6 and 7, under conditions shown in Tables 4 and 5. A high frequency power of VHF region, having a frequency of 105 MHz, was employed as a high-frequency power in Table 4.

In the present example, the intermediate layer was formed out of silicon and magnesium targets, and a content ratio of silicon, carbon and magnesium at the surface of the intermediate layer on the photoconductive layer side was regulated by changing the electric power supplied to the magnesium target within a range of 0 to 500 W at the initial stage of forming the intermediate layer and also by changing the $CH_4$ flow rate. During the formation of the intermediate layer, electric powers applied to the targets and gas flow rates were so regulated as to continuously change the composition in such a manner that the composition of the intermediate layer at its surface on the surface layer side became approximately the same as the composition of the surface layer.

Also the flow rate of $F_2$ was experimentally determined in advance in such a manner that a ratio of Mg and F was allowed to satisfy 1:2 by the electric power supplied to the magnesium target, and was changed according to the experimental value. Further, the flow rate of $CH_4$ was experimentally determined in advance in such a manner that a content ratio of Si and C was allowed to be substantially in consistency with that ratio in the upper charge injection blocking layer by the electric power supplied to the silicon target, and was changed according to the experimental value.

TABLE 4

| | First area layer | | |
|---|---|---|---|
| | lower charge injection blocking layer | photo-conductive layer | upper charge injection blocking layer |
| Gas flow rate | | | |
| $SiH_4$ [ml/min (normal)] | 250 | 300 | 200 |
| $B_2H_6$ (ppm) (to $SiH_4$) | 3000 | 2 | 0 |
| $CH_4$ [ml/min (normal)] | 300 | 0 | 450 |
| $H_2$ [ml/min (normal)] | 150 | 300 | 100 |
| Pressure [Pa] | 1.5 | 1 | 1 |
| High frequency power [W] | 500 | 2000 | 800 |
| Substrate temperature [° C.] | 210 | 230 | 230 |
| Layer thickness [μm] | 3 | 28 | 2 |

TABLE 5

| | Intermediate layer | Second area layer Surface layer |
|---|---|---|
| Gas flow rate | | |
| Ar [ml/min (normal)] | 300 | 300 |
| $H_2$ [ml/min (normal)] | 20 | 20 |
| $F_2$ [ml/min (normal)] | variable → 25 | 25 |
| $CH_4$ [ml/min (normal)] | variable → 0 | 0 |
| Pressure [Pa] | 0.5 | 0.5 |
| RF power [W] | | |
| silicon target | 500 → 0 | 0 |
| magnesium target | variable → 500 | 500 |
| Substrate temperature [° C.] | room temp. | room temp. |
| Layer thickness [μm] | 0.5 | 0.5 |

Electrophotographic photosensitive members thus prepared were evaluated in the same manner as in Example 1. Example 2 is an example in which a difference between a total content ratio of Si and C which are principal constituent elements of the photoconductive layer (total content ratio of Si and C: about 100% (excluding hydrogen)) and a total content ratio of Si and C at the surface of the intermediate layer on the photoconductive layer side is in the range of ±30%, and Comparative Example 3 is an example in which the difference between the content ratios exceeds 30%. The content ratio was measured in the same manner as in Example 1 and Comparative Example 1.

COMPARATIVE EXAMPLE 4

After the first area layer was prepared in the same manner as in Example 2 under conditions shown in Table 4, and without an intermediate layer, a surface layer of magnesium fluoride was formed under conditions for the second area layer as shown in Table 5.

The electrophotographic photosensitive members thus formed were evaluated as in Example 1 and Comparative Example 1, where the image exposing laser had an oscillation wavelength of 660 nm and a spot diameter of 60×60 μm.

Evaluation results in Example 2 and Comparative Examples 3 and 4 are shown in Table 6.

TABLE 6

| | Difference in Si + C content ratio | Charging ability | Photo-sensitivity | Residual potential | Ghost | Gradation |
|---|---|---|---|---|---|---|
| Ex. 2 | 0% (68%) | 1.00/0.96 | 1.00/1.02 | 1.00/0.96 | 1.00/0.98 | A/A |
| | 21% (67%) | 0.96/0.98 | 1.06/1.06 | 1.00/1.00 | 1.05/1.04 | A/A |
| | 29% (67%) | 1.03/1.04 | 1.06/1.09 | 1.28/1.31 | 1.09/1.08 | A/A |
| Comp. Ex. 3 | 32% (66%) | 0.98/1.03 | 1.09/1.13 | 1.60/1.85 | 1.12/1.19 | A/A |
| | 42% (68%) | 0.98/0.97 | 1.12/1.16 | 1.80/2.13 | 1.18/1.23 | A/A |
| Comp. Ex. 4 | 100% (no intermediate layer) | 1.03/1.03 | 1.16/1.18 | 2.10/2.41 | 1.21/1.26 | A/A |

(before durability test/after durability test)

In Table 6, each number in each item is represented by a relative value, taking a value in Example 1 before the durability test as one (1). In Example 2 and Comparative Example 3 in Table 6, a parenthesized number in the item "difference in Si+C content ratio" indicates a Si content ratio in the content of Si and C (Si/Si+C) at the surface of the intermediate layer on the side of the upper charge injection blocking layer of each electrophotographic photosensitive member. The upper charge injection blocking layer has a Si content ratio of 67% in the content of Si and C, so that the Si content ratio can be considered to be substantially the same in all the electrophotographic photosensitive members in consideration of error.

Based on the results shown in Table 6, the electrophotographic photosensitive member of the invention, having a difference within 30% in the total content ratio of Si and C, can be said to provide very satisfactory results on all the characteristics.

On the other hand, a difference exceeding 30% in the total content ratio of Si and C resulted in deteriorations in the photosensitivity, residual potential and ghost, and such deteriorations were further increased by the durability test.

The Example 2 and Comparative Examples 3 and 4 employed a-SiC for the upper charge injection blocking layer. As the image exposing laser of a wavelength of 660 nm employed for the evaluation was unable to provide a spot diameter smaller than 60×60 μm, no particular change in the gradation characteristics was observed, but if a smaller spot diameter is available from the image exposing laser as in Example 1 and Comparative Examples 1, 2, the electrophotographic photosensitive members of Comparative Examples 3, 4 are supposed to show a deterioration in the gradation characteristics.

EXAMPLE 3 AND COMPARATIVE EXAMPLE 5

An electrophotographic photosensitive member of a layer structure shown in FIG. 13 was prepared in the same manner as in Example 2 and Comparative Example 3, by forming a first area layer by a plasma CVD process and then forming an intermediate layer and a second area layer by a sputtering process.

In Example 3 and Comparative Example 5, the intermediate layer does not contain Mg and F at its surface on the upper charge injection blocking layer side, and a ratio of Si and C was changed by varying the flow rates. In the course of formation of the intermediate layer, gas flow rates and electric powers applied to the silicon target and the magnesium target were changed continuously in such a manner that the element content ratios at the surface of the intermediate layer on the surface layer side are substantially in consistency with those of the surface layer.

The flow rate of $CH_4$ was experimentally determined in advance in such a manner that a content ratio of Si and C was allowed to be substantially in consistency with that at the initial stage of forming the intermediate layer by the electric power supplied to the silicon target, and was changed according to the experimental value.

TABLE 7

| | Intermediate layer | Second area layer Surface layer |
|---|---|---|
| Gas flow rate | | |
| Ar [ml/min (normal)] | 300 | 300 |
| $H_2$ [ml/min (normal)] | 20 | 20 |
| $F_2$ [ml/min (normal)] | variable → 25 | 25 |
| $CH_4$ [ml/min (normal)] | variable → 0 | 0 |
| Pressure [Pa] | 0.5 | 0.5 |
| RF power [W] | | |
| silicon target | 500 → 0 | 0 |
| magnesium target | variable → 500 | 500 |
| Substrate temperature [° C.] | room temp. | room temp. |
| Layer thickness [μm] | 0.5 | 0.5 |

Electrophotographic photosensitive members thus prepared were evaluated in the same manner as in Example 1 and Comparative Example 1. Example 3 is an example in which a difference between a total content ratio of Si and C which are principal constituent elements of the photoconductive layer (total content ratio of Si and C: about 100% (excluding hydrogen)) and a total content ratio of Si and C at the surface of the intermediate layer on the photoconductive layer side is in the range of ±30%, and Comparative Example 5 is an example in which the difference in the content ratios exceeds ±30%. The content ratio was measured in the same manner as in Example 1 and Comparative Example 1.

The electrophotographic photosensitive members thus formed were evaluated as in Example 1 and Comparative Example 1, where the image exposing laser had an oscillation wavelength of 660 nm and a spot diameter of 60×60 μm.

Evaluation results in Example 3 and Comparative Example 5 are shown in Table 8.

TABLE 8

| | Difference in Si content ratio | Charging ability | Photo-sensitivity | Residual potential | Ghost | Gradation |
|---|---|---|---|---|---|---|
| Comp. Ex. 5 | −67% (0%) | 0.98/1.02 | 1.16/1.20 | 2.10/2.49 | 1.38/1.78 | A/A |
| | −35% (32%) | 1.05/1.02 | 1.08/1.12 | 1.60/1.80 | 1.28/1.38 | A/A |
| Ex. 3 | −26% (41%) | 1.06/1.02 | 1.06/1.07 | 1.32/1.36 | 1.12/0.15 | A/A |
| | 0% (67%) | 0.99/0.96 | 0.98/0.96 | 1.03/1.00 | 0.98/1.03 | A/A |
| | 28% (95%) | 1.03/1.06 | 1.04/1.06 | 1.26/1.33 | 1.13/1.28 | A/A |
| Comp. Ex. 5 | 33% (100%) | 1.05/1.02 | 1.10/1.13 | 1.65/1.83 | 1.18/1.28 | A/A |

(before durability test/after durability test)

In Table 8, each number in each item is represented by a relative value, taking a value in Example 1 before the durability test as one (1). Results on the charging ability, photosensitivity, residual potential and ghost in Table 8 are respectively shown in FIGS. 14, 15, 16 and 17.

Based on the results shown in Table 8, satisfactory results were obtained on all the characteristics in the case where the difference of the Si content ratio was small. On the other hand, an increase in the difference of the Si content ratio resulted in deteriorations in the photosensitivity, residual potential and ghost.

Also based on the results in FIGS. 14 to 17, a threshold value is supposed to be ±30%.

No difference in the gradation characteristics was observed in the results shown in Table 8, but as in Example 2 and Comparative Examples 3 and 4, if a smaller spot diameter is available from the image exposing laser, the electrophotographic photosensitive member of Comparative Example 5 is supposed to show a deterioration in the gradation characteristics.

The results in Examples 2 and 3, and Comparative Examples 3 to 5 indicate that when the upper charge injection blocking layer is constituted of plural elements, the effect of the present invention can be obtained by regulating the content ratios of the elements at the surface of the intermediate layer on the upper charge injection blocking layer side in such a manner that the difference in the total content ratio of the principal elements is in a range of ±30%, and besides, the difference in the content ratio of each element is in the range of ±30%.

EXAMPLE 4

An electrophotographic photosensitive member was prepared in the same manner as in Example 1, except that the magnesium target in the apparatus shown in FIGS. 6 and 7 was replaced by a lanthanum target to form a surface layer of lanthanum fluoride.

Forming conditions for the intermediate layer and the surface layer are shown in Table 9.

TABLE 9

| | Second area layer | |
|---|---|---|
| | Intermediate layer | Surface layer |
| Gas flow rate | | |
| Ar [ml/min (normal)] | 200 | 200 |
| $H_2$ [ml/min (normal)] | 15 | 15 |
| $F_2$ [ml/min (normal)] | 0 → 25 | 25 |
| Pressure [Pa] | 0.5 | 0.5 |
| RF power [W] | | |
| silicon target | 500 → 0 | 0 |
| lanthanum target | 0 → 500 | 500 |
| Substrate temperature [° C.] | room temp. | room temp. |
| Layer thickness [μm] | 0.3 | 0.5 |

In the formation of the intermediate layer and the surface layer, Ar was supplied from the sputtering gas supply tube 5105, and other gasses were supplied from the reactive gas supplying nozzle 5103. The same evaluation as in Example 1 was conducted using the electrophotographic photosensitive member and samples thus prepared.

EXAMPLE 5

An electrophotographic photosensitive member was prepared in the same manner as in Example 1, except that the magnesium target in the apparatus shown in FIGS. 6 and 7 was replaced by a barium target to form a surface layer of barium fluoride.

Forming conditions for the intermediate layer and the surface layer are shown in Table 10.

TABLE 10

| | Intermediate layer | Second area layer. Surface layer |
|---|---|---|
| Gas flow rate | | |
| Ar [ml/min (normal)] | 300 | 300 |
| $H_2$ [ml/min (normal)] | 60 | 60 |
| $F_2$ [ml/min (normal)] | 0 → 25 | 25 |
| Pressure [Pa] | 0.5 | 0.5 |

TABLE 10-continued

| | Intermediate layer | Second area layer. Surface layer |
|---|---|---|
| RF power [W] | | |
| silicon target | 500 → 0 | 0 |
| barium target | 0 → 800 | 800 |
| Substrate temperature [° C.] | room temp. | room temp. |
| Layer thickness [μm] | 0.3 | 0.5 |

In the formation of the intermediate layer and the surface layer, all the gasses were supplied from the reactive gas supplying nozzle 5103.

The same evaluation as in Example 1 was conducted using an electrophotographic photosensitive member and samples thus prepared.

COMPARATIVE EXAMPLE 6

An electrophotographic photosensitive member employing a-SiC for the surface layer was prepared with a deposition film forming apparatus according to a plasma CVD process shown in FIGS. 3 to 5 under conditions shown in Table 11.

A changing layer with a continuously changing composition was formed between the photoconductive layer and the surface layer.

TABLE 11

| | lower charge injection blocking layer | photo-conductive layer | changing layer | surface layer |
|---|---|---|---|---|
| Gas flow rate | | | | |
| $SiH_4$ [ml/min (normal)] | 100 | 150 | 150 → 30 | 30 |
| $B_2H_6$ (ppm) (to $SiH_4$) | 1000 | 1.5 | 1.5 → 0 | 0 |
| $CH_4$ [ml/min (normal)] | 300 | 0 | 0 → 150 | 150 |
| Pressure [Pa] | 1 | 1 | 0.8 | 0.8 |
| High frequency power [W] | 500 | 2000 | 800 | 800 |
| Substrate temperature [° C.] | 210 | 230 | 200 | 200 |
| Layer thickness [μm] | 3 | 28 | 0.3 | 0.3 |

The same evaluation as in Example 1 was conducted with the electrophotographic photosensitive member and samples thus prepared.

Results in Examples 3 to 5 and Comparative Example 6 are summarized in Table 12.

In Table 12, each number for each of the charging ability, photosensitivity, residual potential and ghost are represented by a relative value, taking a value of Example 1 before the durability test as one (1). The electrophotographic photosensitive members of Examples 3 to 5 provided satisfactory results in all the items, but with the electrophotographic photosensitive member in Comparative Example 6, the photosensitivity could not be measured due to absorption of image exposing light of a wavelength of 405 nm by the surface layer, and an image for evaluation could not be obtained. Also, for the electrophotographic photosensitive member of Comparative Example 6, the durability test was not conducted because an appropriate image could not be obtained, and only values before the durability test are indicated.

Results in Table 12 indicate that the electrophotographic photosensitive member of the invention utilizing a metal fluoride in the surface layer provide satisfactory potential characteristics and gradation characteristics before and after the durability test, even when a short-wavelength of 405 nm was used for image exposure. Also on the dynamic hardness, better results could be obtained than in the case of a-SiC.

In Table 12, changes in the values of the charging ability, photosensitivity, residual potential and ghost before and after the durability test are within permissible fluctuation ranges.

EXAMPLE 6

An electrophotographic photosensitive member of a layer structure shown in FIG. 1 was formed using silicon nitride as the surface layer, where the lower charge injection blocking layer and the photoconductive layer were formed by a plasma CVD process, and then, the intermediate layer and the surface layer were formed by a sputtering process. In the layer formations, the plasma CVD process was executed using an apparatus shown in FIGS. 3 to 5, and the sputtering process was executed using an apparatus shown in FIGS. 6 and 7, through procedures similar to those in Example 1.

The lower charge injection blocking layer and the photoconductive layer were formed under conditions shown in Table 13, and the intermediate layer and the surface layer

TABLE 12

| | Charging ability | Photo-sensitivity | Residual potential | Ghost | Gradation | Dynamic hardness kN/mm² | Dynamic hardness (kg/mm²) |
|---|---|---|---|---|---|---|---|
| Ex. 3 | 0.98/0.98 | 0.96/0.95 | 1.00/1.03 | 0.97/0.96 | A/A | 9.61 | (980) |
| Ex. 4 | 0.95/0.98 | 0.95/0.98 | 0.96/0.98 | 1.06/1.08 | A/A | 9.64 | (983) |
| Ex. 5 | 1.09/1.10 | 0.99/0.95 | 1.00/1.00 | 0.95/0.93 | A/A | 7.83 | (798) |
| Comp. Ex. 6 | 0.97 | — | 28 | — | — | 7.06 | (720) |

(before durability test/after durability test)

were formed under conditions shown in Table 14. As a high frequency power in Table 13, a VHF band of a frequency of 105 MHz was employed.

The intermediate layer was formed as a changing layer by employing a silicon target and varying a flow rate of nitrogen ($N_2$).

TABLE 13

| | First area layer | |
|---|---|---|
| | lower charge injection blocking layer | photoconductive layer |
| Gas flow rate | | |
| $SiH_4$ [ml/min (normal)] | 250 | 300 |
| $B_2H_6$ (ppm) (to $SiH_4$) | 3000 | 2 |
| $CH_4$ [ml/min (normal)] | 150 | 300 |
| Pressure [Pa] | 1.5 | 1 |
| High frequency power [W] | 500 | 2000 |
| Substrate temperature [° C.] | 210 | 230 |
| Layer thickness [μm] | 3 | 28 |

TABLE 14

| | Intermediate layer | Second area layer Surface layer |
|---|---|---|
| Gas flow rate | | |
| Ar [ml/min (normal)] | 300 | 300 |
| $H_2$ [ml/min (normal)] | 20 | 20 |
| $N_2$ [ml/min (normal)] | 0 → 300 | 300 |
| Pressure [Pa] | 0.5 | 0.5 |
| RF power [W] | | |
| silicon target | 500 | 500 |
| Substrate temperature [° C.] | room temp. | room temp. |
| Layer thickness [μm] | 0.3 | 0.5 |

In the formation of the intermediate layer and the surface layer, Ar was supplied from the sputtering gas supply tube 5105, and other gasses were supplied from the reactive gas supplying nozzle 5103.

As for the surface layer, a sample was formed on a glass substrate under conditions shown in Table 11.

The same evaluation as in Example 1 was conducted using the electrophotographic photosensitive member and the sample thus prepared, where an image exposing laser had an oscillation wavelength of 405 nm and a spot diameter of 30×40 μm.

EXAMPLE 7

An electrophotographic photosensitive member having a surface layer of silicon nitride was formed only by a plasma CVD process, using a deposition film forming apparatus according to a plasma CVD process shown in FIGS. 3 to 5 under conditions shown in Table 15.

TABLE 15

| | lower charge injection blocking layer | photo-conductive layer | changing layer | surface layer |
|---|---|---|---|---|
| Gas flow rate | | | | |
| $SiH_4$ [ml/min (normal)] | 250 | 300 | 300 → 30 | 30 |
| $B_2H_6$ (ppm) (to $SiH_4$) | 3000 | 2 | 2 → 0 | 0 |
| $N_2$ [ml/min (normal)] | 150 | 0 | 0 → 450 | 450 |
| Pressure [Pa] | 1.5 | 1 | 1 → 2.5 | 2.5 |
| High frequency power [W] | 500 | 2000 | 2000 | 2000 |
| Substrate temperature [° C.] | 210 | 230 | 230 → 200 | 200 |
| Layer thickness [μm] | 3 | 28 | 0.3 | 0.5 |

As a high frequency power in Table 15, a VHF band of a frequency of 105 MHz was employed.

Also, as in Example 1, a sample of the surface layer was formed on a glass substrate under conditions shown in Table 15.

The same evaluation as in Example 1 was conducted using the electrophotographic photosensitive member and the samples thus prepared.

Results in Examples 6 and 7 are summarized in Table 16.

TABLE 16

| | Charging ability | Photo-sensitivity | Residual potential | Ghost | Gradation | Dynamic hardness kN/mm$^2$ | (kg/mm$^2$) |
|---|---|---|---|---|---|---|---|
| Ex. 6 | 1.03/0.99 | 0.98/0.98 | 0.96/0.96 | 1.03/1.03 | A/A | 10.08 | (1028) |
| Ex. 7 | 0.98/0.95 | 1.45/1.46 | 1.36/1.38 | 1.16/1.15 | B/B | 9.70 | (989) |

(before durability test/after durability test)

In Table 16, each number for each of the charging ability, photosensitivity, residual potential and ghost is represented by a relative value, taking a value of Example 1 before the durability test as one (1).

As shown in Table 16, the electrophotographic photosensitive member in Example 6 provided satisfactory results in all the items. On the other hand, the electrophotographic photosensitive member in Example 7 showed certain deteriorations in the photosensitivity, residual potential, ghost and gradation characteristics due to an unevenness resulting from the formation of silicon nitride by the plasma CVD process, but they were all within such an extent that an evident difference on the image could not be observed under the evaluating conditions of the present example.

The dynamic hardness measured with the aforementioned sample was satisfactory in both Examples 6 and 7, with the difference between the two could be judged to be within a permissible fluctuation range.

As explained above, the surface layer of silicon nitride shows, even when formed by a plasma CVD process, satisfactory characteristics for an image exposure with a short wavelength, but tends to generate an unevenness in consideration of the entire area of the electrophotographic photosensitive member. On the other hand, a sputtering process could form the surface layer of silicon nitride having uniform characteristics over the entire area of the electrophotographic photosensitive member.

Thus, it is desirable to select, depending on the material constituting the surface layer, a deposition film forming process suitable for such material, in order to fully bring out the characteristics thereof.

EXAMPLE 8

An electrophotographic photosensitive member of a layer structure shown in FIG. 1 was formed using magnesium fluoride as the surface layer, where the lower charge injection blocking layer and the photoconductive layer were formed by a plasma CVD process, and then, the intermediate layer and the surface layer were formed by a sputtering process. In the formation of the electrophotographic photosensitive member, the plasma CVD process was executed with an apparatus shown in FIGS. 3 to 5 while the sputtering process was executed with an apparatus shown in FIGS. 6 and 7, through procedures similar to those in Example 1.

The lower charge injection blocking layer and the photoconductive layer were formed under conditions shown in Table 17, and the intermediate layer and the surface layer were formed under conditions shown in Table 18. As a high frequency power in Table 13, a VHF band of a frequency of 105 MHz was employed.

The intermediate layer was formed with a continuously changing composition by employing a silicon target and a magnesium target and varying electric powers applied respectively to the targets, but an area with a constant composition was provided in the intermediate layer on the photoconductive layer side.

TABLE 17

| | First area layer | |
|---|---|---|
| | lower charge injection blocking layer | photoconductive layer |
| Gas flow rate | | |
| $SiH_4$ [ml/min (normal)] | 250 | 300 |
| $B_2H_6$ (ppm) (to $SiH_4$) | 3000 | 2 |
| $CH_4$ [ml/min (normal)] | 300 | 0 |
| $H_2$ [ml/min (normal)] | 150 | 300 |
| Pressure [Pa] | 1.5 | 1 |
| High frequency power [W] | 500 | 2000 |
| Substrate temperature [° C.] | 210 | 230 |
| Layer thickness [μm] | 3 | 28 |

TABLE 18

| | Intermediate layer | | Second area layer |
|---|---|---|---|
| | constant area | changing area | Surface layer |
| Gas flow rate | | | |
| Ar [ml/min (normal)] | 300 | 300 | 300 |
| $H_2$ [ml/min (normal)] | 20 | 20 | 20 |
| $F_2$ [ml/min (normal)] | 0 | 0 → 10 | 10 |
| Pressure [Pa] | 0.5 | 0.5 | 0.5 |
| RF power [W] | | | |
| silicon target | 500 | 500 → 0 | 0 |
| magnesium target | 0 | 0 → 500 | 500 |
| Substrate temperature [° C.] | room temp. | room temp. | room temp. |
| Layer thickness [μm] | 0.3 | 0.5 | 0.5 |

In the formation of the intermediate layer and the surface layer, Ar was supplied from the sputtering gas supply tube 5105, and other gasses were supplied from the reactive gas supplying nozzle 5103. Also, as in Example 1, a sample of the surface layer was formed on a glass substrate under conditions shown in Table 18.

EXAMPLE 9

An electrophotographic photosensitive member of a layer structure shown in FIG. 1 was formed using magnesium fluoride as the surface layer, where the lower charge injection blocking layer and the photoconductive layer were by a plasma CVD process, and then, the intermediate layer and the surface layer were formed by a sputtering process. In the layer formations, the plasma CVD process was executed using an apparatus shown in FIGS. 3 to 5 while the sputtering process was executed using an apparatus shown in FIGS. 6 and 7, through procedures similar to those in Example 1.

The lower charge injection blocking layer and the photoconductive layer were formed under conditions shown in Table 19, and the intermediate layer and the surface layer were formed under conditions shown in Table 20. As a high frequency power in Table 13, a VHF band of a frequency of 105 MHz was employed.

In the present example, the intermediate layer was formed, without employing a silicon target, by supplying $SiH_4$ gas and applying an electric power to a magnesium target to generate a plasma, thereby executing a plasma CVD process and a sputtering process substantially in combination and thus causing a change in the composition.

TABLE 19

| | First area layer | |
|---|---|---|
| | lower charge injection blocking layer | photoconductive layer |
| Gas flow rate | | |
| $SiH_4$ [ml/min (normal)] | 300 | 300 |
| $B_2H_6$ (ppm) (to $SiH_4$) | 1000 | 2 |
| $H_2$ [ml/min (normal)] | 150 | 300 |
| Pressure [Pa] | 1.5 | 1 |
| High frequency power [W] | 500 | 1200 |
| Substrate temperature [° C.] | 210 | 230 |
| Layer thickness [μm] | 3 | 28 |

TABLE 20

| | Intermediate layer | Second area layer Surface layer |
|---|---|---|
| Gas flow rate | | |
| Ar [ml/min (normal)] | 300 | 300 |
| $H_2$ [ml/min (normal)] | 20 | 20 |
| $SiH_4$ [ml/min (normal)] | 200 → 0 | |
| $F_2$ [ml/min (normal)] | 0 → 30 | 30 |
| Pressure [Pa] | 0.5 | 0.5 |
| RF power [W] | | |
| magnesium target | 100 → 800 | 500 |
| Substrate temperature [° C.] | room temp. | room temp. |
| Layer thickness [μm] | 0.3 | 0.5 |

In the formation of the intermediate layer and the surface layer, Ar was supplied from the sputtering gas supply tube 5105, and other gasses were supplied from the reactive gas supplying nozzle 5103. Also, as in Example 1, a sample of the surface layer was formed on a glass substrate under conditions shown in Table 20.

Examples 8 and 9 employed an image exposing laser with an oscillation wavelength of 405 nm and spot diameters (main-scanning spot diameter and sub-scanning spot diameter) of 23 μm×32 μm.

Results in Examples 8 and 9 are shown in Table 21.

TABLE 21

| | Charging ability | Photo-sensitivity | Residual potential | Ghost | Gradation | Dynamic hardness kN/mm$^2$ | Dynamic hardness (kg/mm$^2$) |
|---|---|---|---|---|---|---|---|
| Ex. 8 | 0.95/0.98 | 1/1.04 | 0.99/1.04 | 0.95/0.96 | A/A | 9.61 | (980) |
| Ex. 9 | 0.96/0.96 | 0.99/0.95 | 1.06/1.03 | 0.96/0.98 | A/A | 9.77 | (996) |

(before durability test/after durability test)

In Table 21, each number for each of the charging ability, photosensitivity, residual potential and ghost are represented by a relative value, taking a value in Example 1 before the durability test as one (1).

As will be apparent from Table 21, the electrophotographic photosensitive members in Examples 8 and 9 showed satisfactory results on all the items.

This application claims priority from Japanese Patent Application Nos. 2004-074413 filed Mar. 16, 2004, and 2005-074570 filed Mar. 16, 2005, which are hereby incorporated by reference herein.

What is claimed is:

1. A method for forming an electrophotographic photosensitive member, which comprises forming in succession on a conductive substrate a first area layer including a photoconductive layer composed essentially of amorphous silicon and a second area layer including a surface layer, wherein the first area layer and the second area layer are formed by different deposition film forming processes, and an intermediate layer is provided between the first area layer and the second area layer and is continuously changed in its composition using in combination a process for forming the first area layer and a process for forming the second area layer in such a manner that a composition of the intermediate layer at its surface on the first area layer side is approximately the same as a composition of the first area layer at its surface on the intermediate layer side and that a composition of the intermediate layer at its surface on the second area layer side is approximately the same as a composition of the second area layer at its surface on the intermediate layer side.

2. A method for forming an electrophotographic photosensitive member according to claim 1, wherein the first area layer is formed by a plasma CVD process and the second area layer is formed by a sputtering process.

* * * * *